US011090225B2

(12) United States Patent
Vlahinos et al.

(10) Patent No.: US 11,090,225 B2
(45) Date of Patent: Aug. 17, 2021

(54) PROTECTION DEVICE THAT PROMOTES AIR FLOW FOR HEAT TRANSFER

(71) Applicant: Thaddeus Medical Systems, Inc., Rochester, MN (US)

(72) Inventors: Andreas Vlahinos, Castle Rock, CO (US); Stephen Joseph Scully, Jr., Rochester, MN (US)

(73) Assignee: Thaddeus Medical Systems, Inc., Rochester, MN (US)

( * ) Notice: Subject to any disclaimer, the term of this patent is extended or adjusted under 35 U.S.C. 154(b) by 120 days.

(21) Appl. No.: 16/297,096

(22) Filed: Mar. 8, 2019

(65) Prior Publication Data

US 2019/0274925 A1 Sep. 12, 2019

Related U.S. Application Data

(60) Provisional application No. 62/640,512, filed on Mar. 8, 2018.

(51) Int. Cl.

*A61J 1/16* (2006.01)
*B65D 81/38* (2006.01)
(Continued)

(52) U.S. Cl.

CPC ..... *A61J 1/165* (2013.01); *A42B 3/125* (2013.01); *A42B 3/283* (2013.01); *B01L 9/00* (2013.01); *B01L 9/06* (2013.01); *B65D 25/108* (2013.01); *B65D 81/113* (2013.01); *B65D 81/18* (2013.01); *B65D 81/3813* (2013.01); *F25B 21/02* (2013.01); *F25D 17/04* (2013.01); *F28F 13/003* (2013.01); *A42B 3/227* (2013.01); *B01L 2200/147* (2013.01); *B01L 2200/185* (2013.01); *B01L 2300/123* (2013.01); *B01L 2300/1822* (2013.01); *F25B 21/04* (2013.01); *F25B 2321/0251* (2013.01)

(58) Field of Classification Search

CPC ..... A61J 1/165; A42B 3/125; B65D 81/18; B65D 81/113; B65D 71/70; F25B 21/02; F25D 17/04; F25D 3/08; F25D 11/03; F25D 2331/8014

See application file for complete search history.

(56) References Cited

U.S. PATENT DOCUMENTS 9,714,173 B2 7/2017 Wiesner et al.

FOREIGN PATENT DOCUMENTS

CN 210063770 U * 2/2020

OTHER PUBLICATIONS

CN-210063770-U translation.*

(Continued)

*Primary Examiner* — Elizabeth J Martin

(74) *Attorney, Agent, or Firm* — Schwegman Lundberg & Woessner, P. A.

(57) ABSTRACT

A portable fluid transportation enclosure can include a specimen carrier within a portable container that can be transported portably by a user. The carrier can define one or more specimen bores therein, where each specimen bore can be configured to receive a specimen therein. Such a gyroid shaped carrier within a container can improve heat transfer between specimen supported by the carrier and can help to limit shock transferred to the specimen within the carrier, such as from an impact to the container in which the gyroid carrier is located.

20 Claims, 20 Drawing Sheets

(51) Int. Cl.

| | |
|---|---|
| ***B65D 81/18*** | (2006.01) |
| ***B65D 81/113*** | (2006.01) |
| ***A42B 3/28*** | (2006.01) |
| ***F25B 21/02*** | (2006.01) |
| ***F28F 13/00*** | (2006.01) |
| ***F25D 17/04*** | (2006.01) |
| ***A42B 3/12*** | (2006.01) |
| ***B65D 25/10*** | (2006.01) |
| ***B01L 9/06*** | (2006.01) |
| ***B01L 9/00*** | (2006.01) |
| ***A42B 3/22*** | (2006.01) |
| ***F25B 21/04*** | (2006.01) |

(56) References Cited

OTHER PUBLICATIONS

Schoen, Alan H, "Infinite Periodic Minimal Surfaces Without Self-Intersections", National Aeronautics and Space Administration, [Online]. Retrieved from the Internet: https: ntrs.nasa.gov archive nasa casi.ntrs.nasa.gov 19700020472.pdf, (May 1970), 100 pages.

* cited by examiner

PROTECTION DEVICE THAT PROMOTES AIR FLOW FOR HEAT TRANSFER

CLAIM OF PRIORITY

This patent application claims the benefit of priority, under 35 U.S.C. Section 119(e), to Andreas Vlahinos, U.S. Patent Application Ser. No. 62/640,512, entitled "FLUID TRANSPORTATION ENCLOSURE WITH DIRECTED COOLING," filed on Mar. 8, 2018 which is hereby incorporated by reference herein in its entirety.

BACKGROUND

The present disclosure relates generally to transportation devices for fluids. In various circumstances, fluids may require transportation. For example, vials of a vaccine or tubes of blood may be transported between facilities or laboratories. Some of the fluids requiring transport may be damaged by relatively extreme ambient conditions such as high temperature.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

To accommodate transportation of temperature sensitive fluids, containers having passive or active temperature control can be used. Some transportation enclosures can use active cooling to maintain an internal temperature of the enclosure during transportation of the fluids. Some active cooling systems can use ambient air to cool one or more cavities within the enclosure and can use convection to transfer heat between the fluids and the ambient environment. However, some of these devices using convection may inefficiently transfer heat between the air and tubes or other containers holding samples within the enclosure.

The techniques of this disclosure can help provide a solution to these issues such as through use of a carrier. The carrier can provide structure sufficient to support the tubes while also providing integral flow channels configured to promote airflow to and from the tubes, such as during natural convection. The channels and bores can help promote relatively even distribution of air flow to each area of the carrier for relatively even heating and cooling of specimen within tubes ("specimen") or other containers supported therein. Because the carrier can provide structural support and can help promote efficient heat transfer, less material may be used. Further, because the carrier may be relatively light weight, the carrier may help reduce an overall weight of the container. Though lightweight, the carrier can be of relatively high strength to help absorb shock and vibration (such as caused by drop) to limit transfer of the forces to objects within the carrier.

This devices and systems described herein may also be applicable to protecting and ventilating a head of a person in the form of padding of a helmet.

Figure 1:
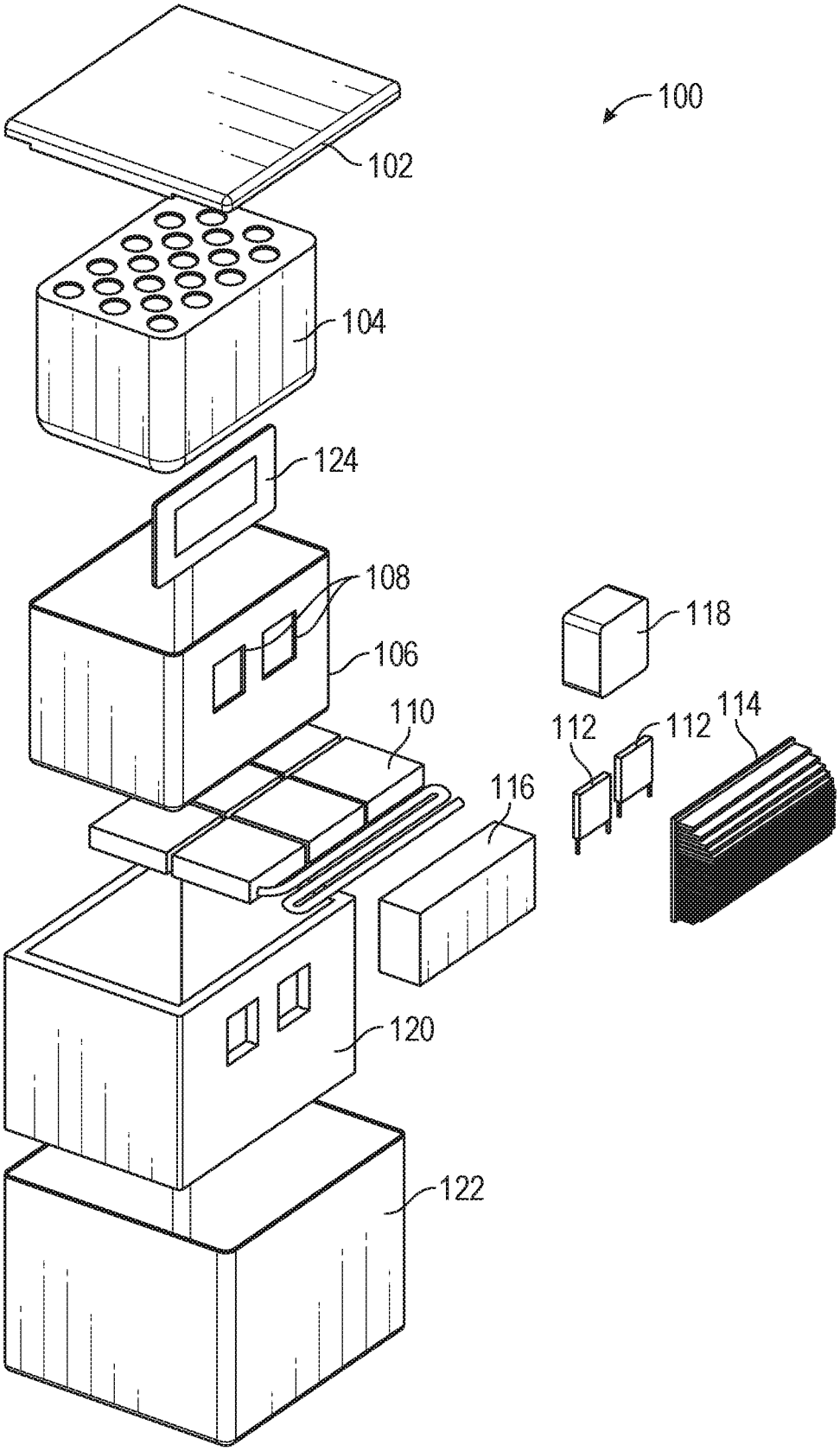
FIG. 1 illustrates an exploded view of a transportation enclosure, in accordance with at least one example of this disclosure.

FIG. 1 illustrates an exploded view of a transportation enclosure, in accordance with at least one example of this disclosure. The transportation enclosure can include a carrier, an outer enclosure, multiple inner enclosures, a lid, one or more heating/cooling devices, a power supply, a heat exchanger, and other components. In some examples, the heating/cooling device can include a passive heat sink. In other examples, the heating cooling device can include a thermo-electric cooler (e.g., Peltier device).

The outer enclosure can include, for example, a structurally rigid housing configured to receive all of the other components therein, such as the carrier therein, such as where all of the components received within the outer enclosure can be sealed in by a lid. The carrier can be sized to directly receive specimens. In some examples, the specimens can be containers containing fluids or samples, such as elongate tubes. In other examples, the specimens can be containers of other shapes or sizes, such as sealable dishes, bags, et cetera. In some examples, the gyroid container can be user-removable from the outer enclosure. This can allow for gyroid containers having bores supporting different specimen containers to be interchanged by a user, such as to allow customization within the outer enclosure for accommodating various samples. The enclosure of FIG. 1 is discussed in further details below.

FIG. 1 illustrates an exploded view of a transportation enclosure 100, in accordance with at least one example of this disclosure. The transportation enclosure 100 can include a lid 102, a housing 104 or carrier, a cooling device 106 (including openings 108), a power supply 110, heating/cooling devices 112, a heat exchanger 114, control modules 116, a heat sink 118, insulation 120, and a container 122.

The components of the transportation enclosure 100 can be made of one or more of metals, plastics, foams, elastomers, ceramics, composites, combinations thereof, or the like. Many of the components of the enclosure 100 can be made of insulative materials, such as one or more of plastics, foams, or the like to help maintain a desired temperature within the enclosure 100.

The lid 102 can be an insulative lid configured to enclose one or more sides of the enclosure 100. The lid 102 can be releasably securable to the container 122 via interference fit or other temporary locking interface such as through use of a set of clips.

The carrier 104 can be a support structure configured to releasably secure one or more tubes, vials, specimen containers, or the like. The cooling device 106 can be a housing sized and shaped to enclose one or more cooling components and the carrier 104. The cooling device 106 can include one or more openings 108 extending therethrough.

The power supply 110 can be a battery and circuitry configured to provide power to the heating and cooling devices 112 during transportation of the enclosure 100. The power supply 110 can be rechargeable in some examples. The heating/cooling devices 112 can be one or more devices configured to provide heating and/or cooling to the cooling device 106 and the contents therein and the heating/cooling devices 112 can be located at least partially within the openings 108 for thermal interaction with the cooling device 106. The heating/cooling devices 112 can be thermoelectric coolers (such as Peltier coolers) or other heatpump devices using, for example refrigerant, to heat and cool the cooling device 106 and the contents therein. In some examples, the heating/cooling devices 112 can be only a heating device or only a cooling device, depending on the requirements of the contents of the enclosure 100.

The heat exchanger 114 can be supported by the container 122 and in thermal communication with the cooling devices 112 and an ambient environment (i.e. outside of the container 122). In some examples, the heat exchanger 114 can extend outside of the container 122. In some examples, the heat exchanger can be in direct contact with the heating/cooling devices 112 to allow for conduction therebetween.

The control modules 116 can include one or more devices for controlling operation of the enclosure 100, such as one or more temperature sensors, and a controller. The control modules 116 can be connected to the power supply 110 and the heating/cooling devices 112 to distribute power to the heating/cooling devices 112 and to control the operation of the heating/cooling devices 112. The control modules 116 can include a programmable controller, such as a single or multi-board computer, a direct digital controller (DDC), or a programmable logic controller (PLC). In other examples the controller can be any computing device, such as a handheld computer, for example, a smart phone, a tablet, a laptop, a desktop computer, or any other computing device including a processor and wireless communication capabilities.

The heat sink 118 can be a heat exchanger for exchanging heat between samples within the carrier 104 and the heating/cooling devices 112, either directly or indirectly. In some examples, the heat sink 118 can be comprised of a material having a high thermal conductivity such as one or more of copper, aluminum, or the like. The heat sink 118 can include one or more fins to help improve heat transfer.

The insulation 120 can be positioned within the container 122 and can be configured to help thermally isolate the components within the container 122 such as the samples supported by the carrier 104. The container 122 can be a rigid or semi-rigid body configured to protect, together with the insulation 120, items within the carrier 104, the heating/cooling devices 112, etc. The container 122 can include walls 123 defining a cavity therein, where the cavity can receive the various components of the enclosure 100.

In operation of some examples, the lid 102 can be removed and specimens or other items can be inserted into the carrier 104. The lid 102 can then be replaced to engage the container 122 to close the enclosure 100 for transportation. When the lid 102 is close (and in some examples when it is not) the control module can monitor a temperature within the carrier 104, for example using a temperature sensor. When the control module 116 determines that a temperature setpoint is not met within the carrier, the control module 116 can enable the heating/cooling devices 112 to exchange heat between the ambient environment (for example using the heat exchanger 114) and the carrier 104.

In some examples, convection can be used for cooling and/or heating of the carrier (for example where the heat sink 118 and/or heat exchanger 114 includes one or more fans). In such an example, air can be transferred from the heat sink 118 to the carrier through the material of the carrier itself, as described below in further detail. By directing airflow through the carrier 104, the air can come in direct contact with the specimens within the carrier 104 for efficient cooling thereof (via direct heat transfer between the cooling medium and the specimens or samples). Such an enclosure can thereby help to maintain a desired temperature of the specimens or samples within the enclosure 100 during transportation. Further details of these and similar components are discussed below with respect to FIGS. 2-8.

Figure 2:
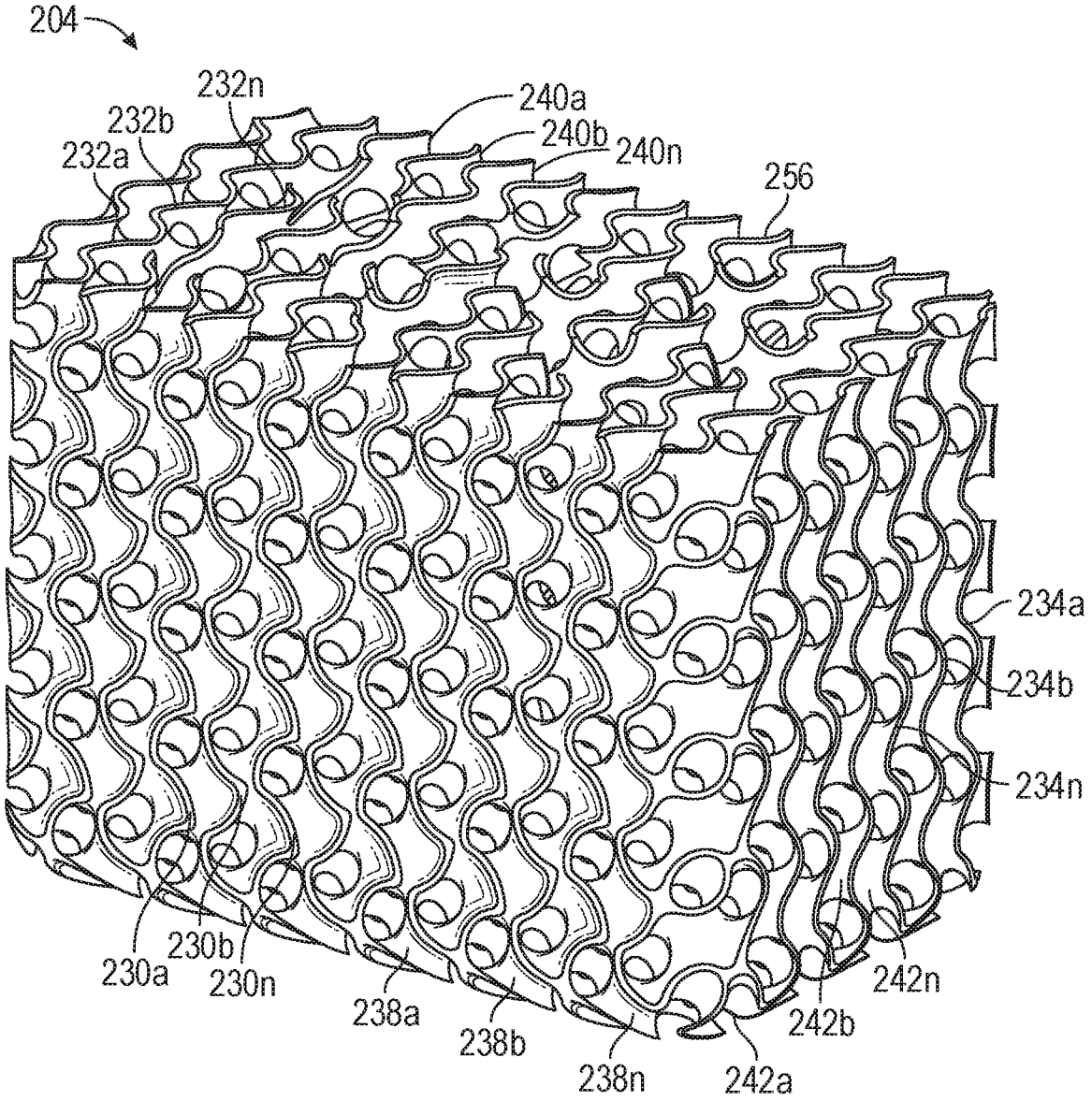
FIG. 2 illustrates an isometric view of a portion of a transportation enclosure, in accordance with at least one example of this disclosure.
Figure 3:
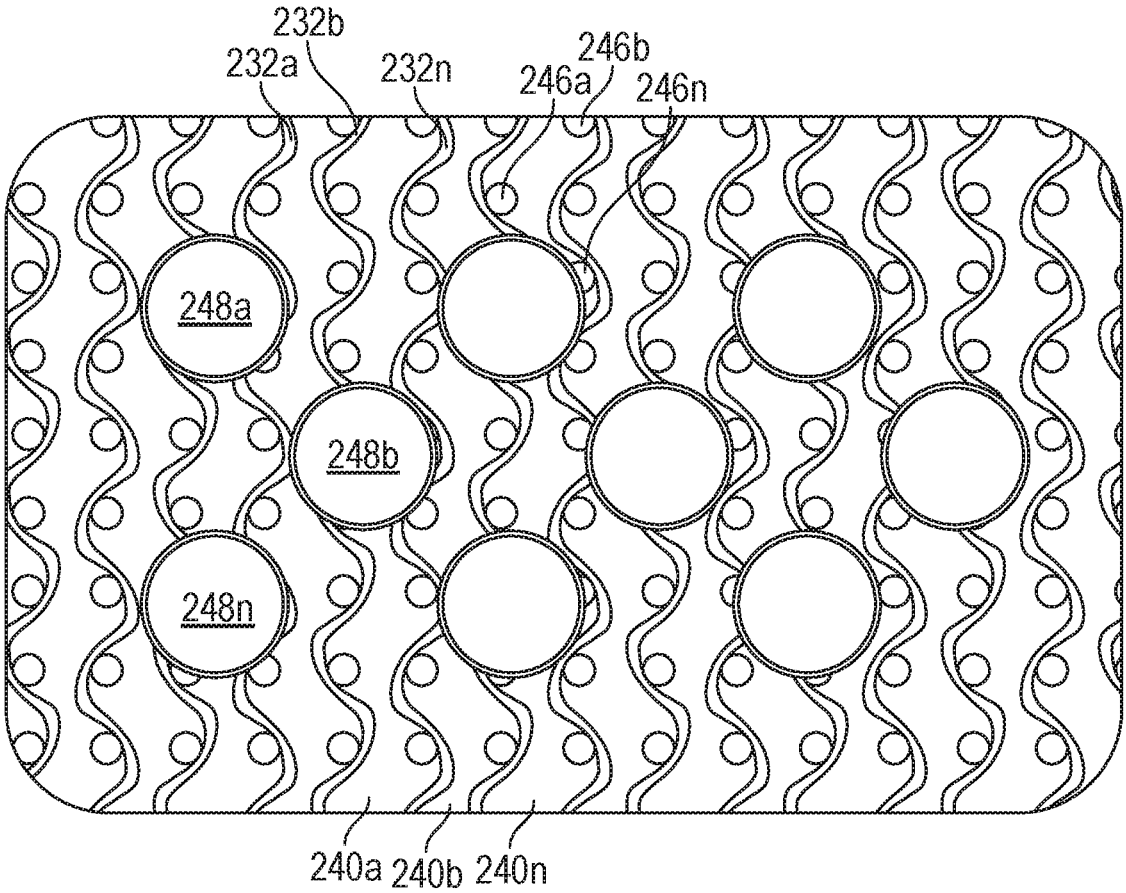
FIG. 3 illustrates a top view of a portion of a transportation enclosure, in accordance with at least one example of this disclosure.
Figure 4:
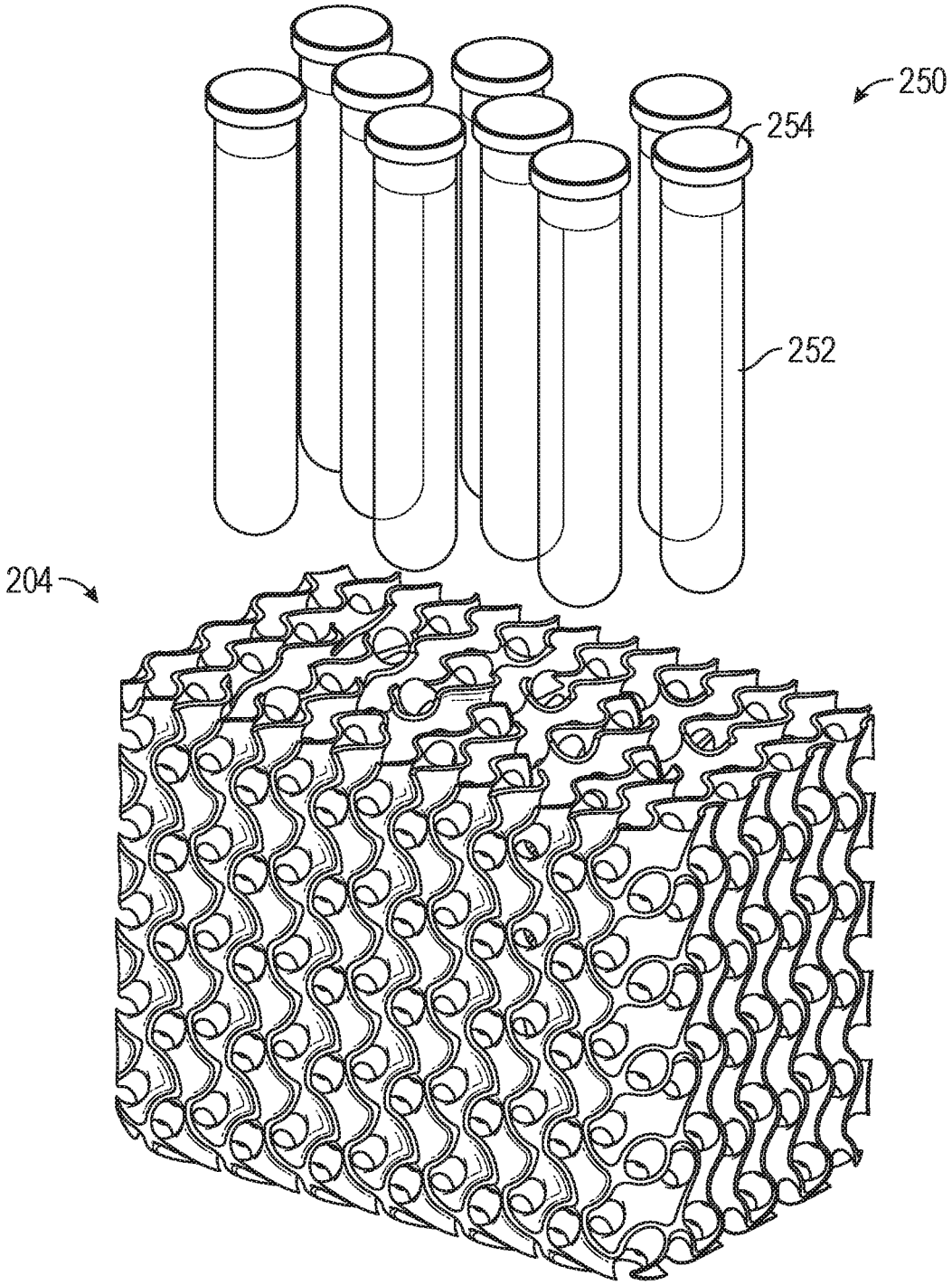
FIG. 4 illustrates an isometric view of a portion of a transportation enclosure in a first condition, in accordance with at least one example of this disclosure.
Figure 5:
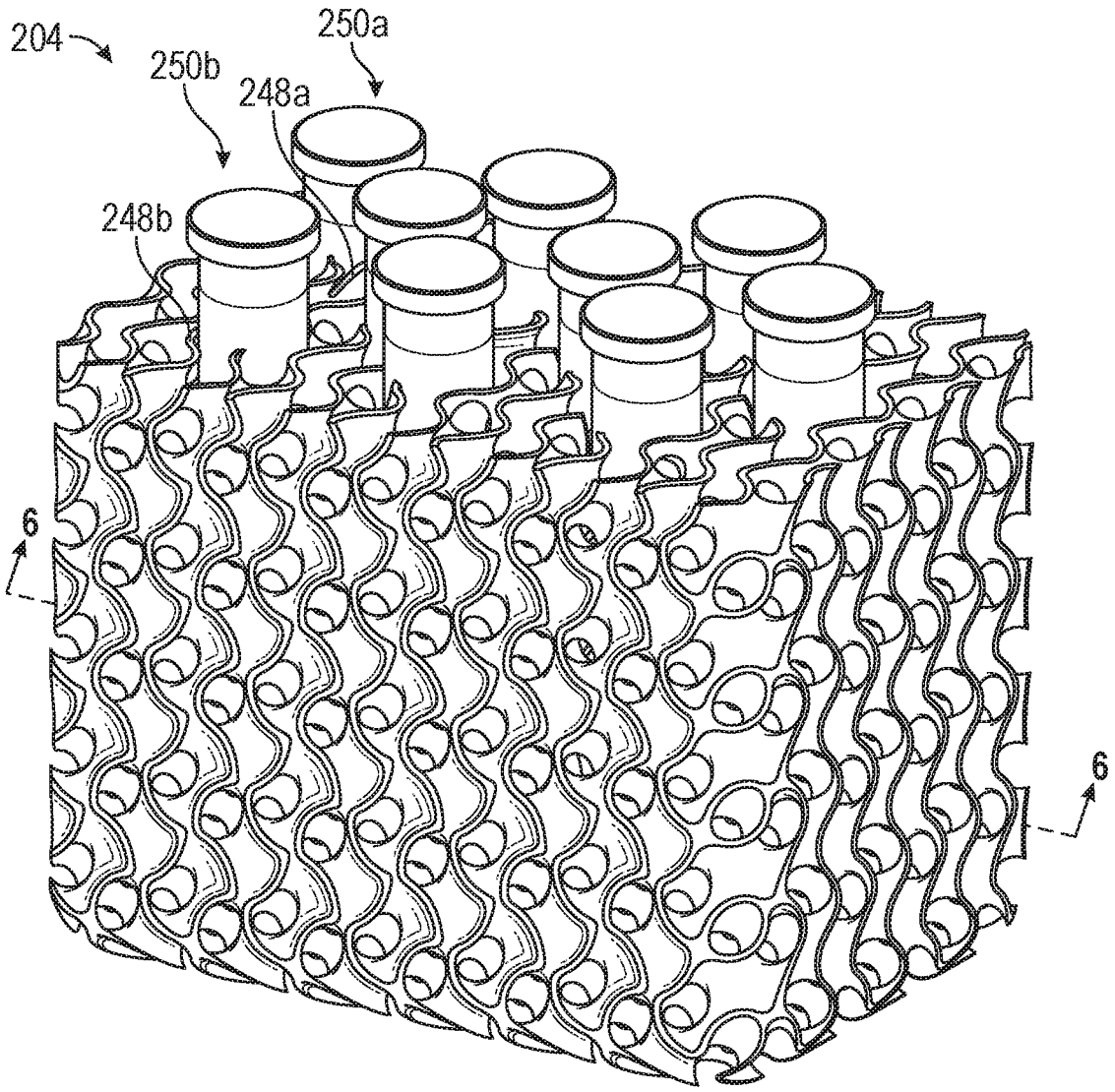
FIG. 5 illustrates an isometric view of a portion of a transportation enclosure in a second condition, in accordance with at least one example of this disclosure.
Figure 6:
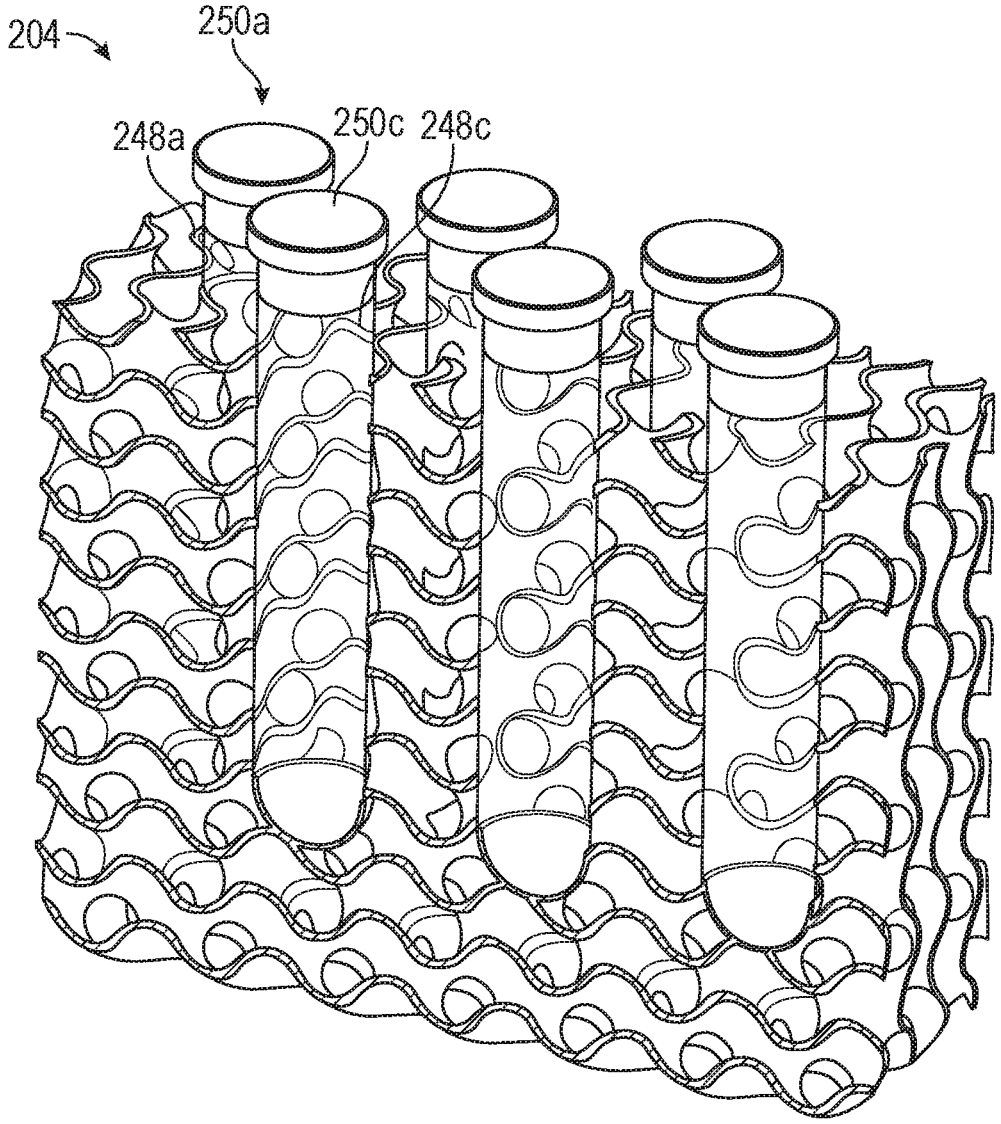
FIG. 6 illustrates an isometric cross-section view of the portion of the transportation enclosure of FIG. 5, in accordance with at least one example of this disclosure.
Figure 7:
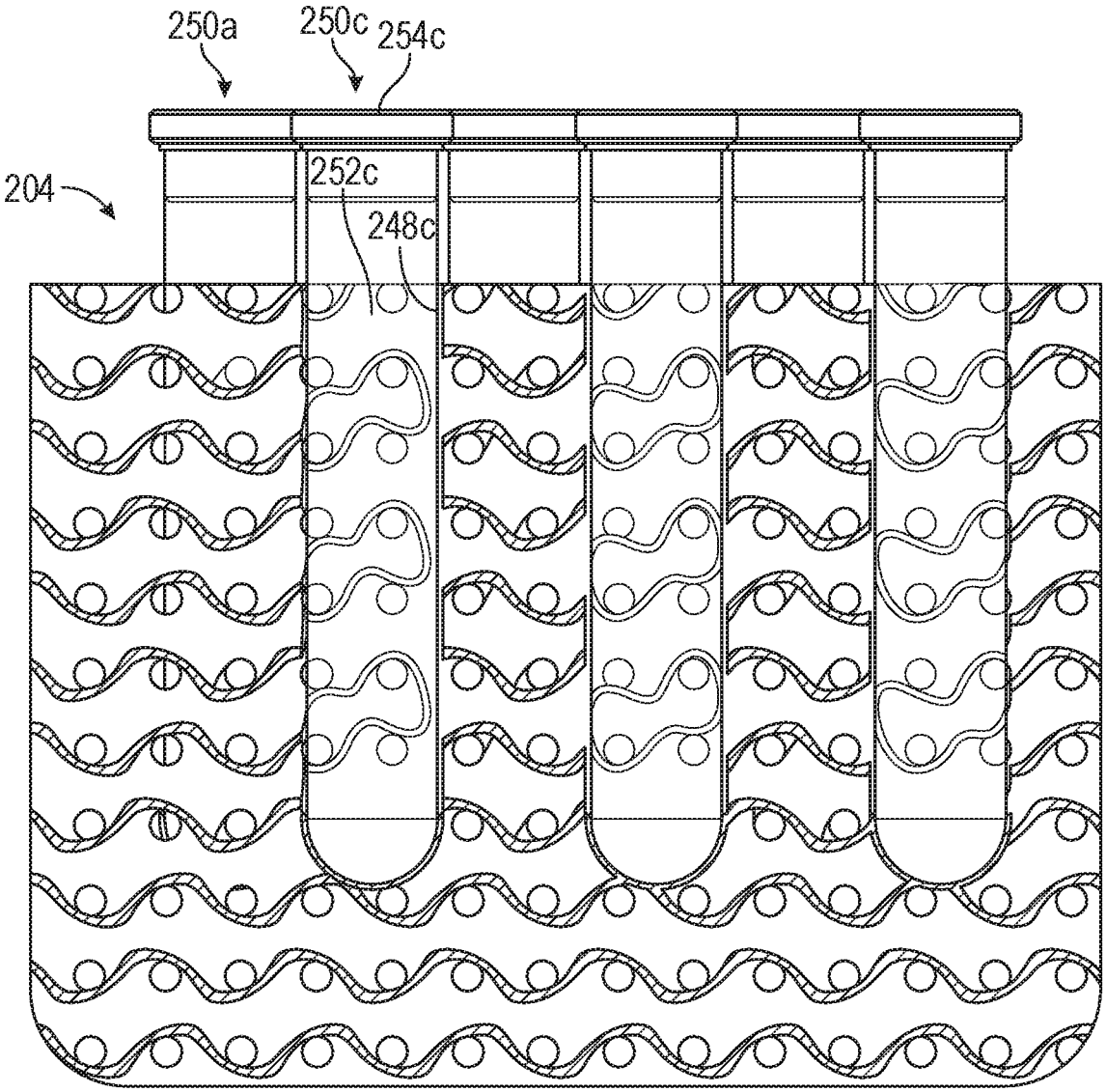
FIG. 7 illustrates an elevation cross-section view of the portion of the transportation enclosure of FIG. 5, in accordance with at least one example of this disclosure.
Figure 8:
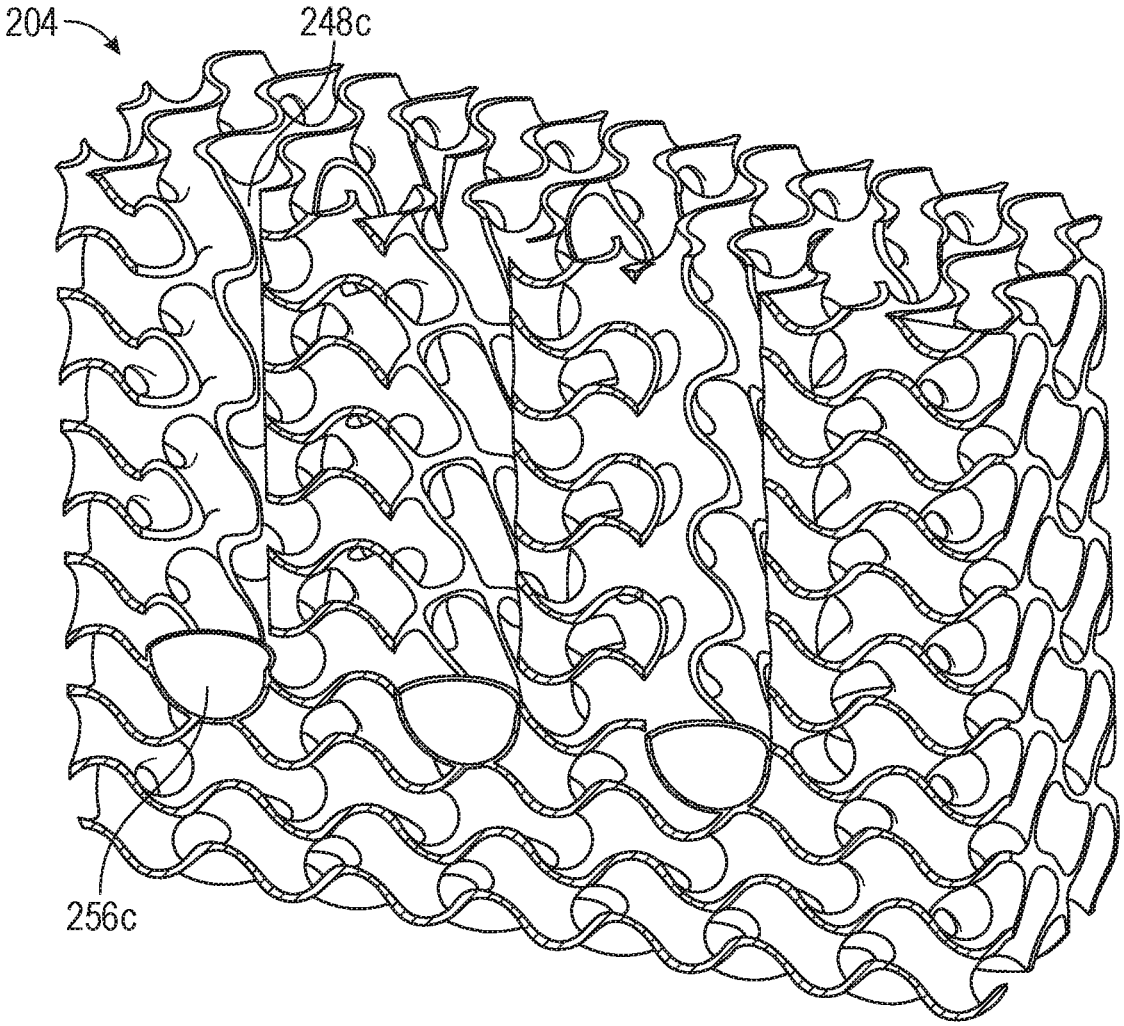
FIG. 8 illustrates an isometric cross-section view of the portion of the transportation enclosure of FIG. 2, in accordance with at least one example of this disclosure.

FIG. 2 illustrates an isometric view of a carrier or enclosure 204, in accordance with at least one example of this disclosure. FIG. 3 illustrates a top view of a portion of the carrier 204, in accordance with at least one example of this disclosure. FIG. 4 illustrates an isometric view of a portion of the carrier 204 in a first condition, in accordance with at least one example of this disclosure. FIG. 5 illustrates an isometric view of a portion of the carrier 204 in a second condition, in accordance with at least one example of this disclosure. FIG. 6 illustrates an isometric cross-section view of the portion of the carrier 204 of FIG. 5, in accordance with at least one example of this disclosure. FIG. 7 illustrates an elevation cross-section view of the portion of the carrier 204 of FIG. 5, in accordance with at least one example of this disclosure. FIG. 8 illustrates an isometric cross-section view of the portion of the carrier 204 of FIG. 2, in accordance with at least one example of this disclosure. FIGS. 2-8 are discussed concurrently below.

The carrier or enclosure 204 can include vertical corrugations 230*a*-230*n* (collectively referred to as vertical corrugations 230), horizontal corrugations 232*a*-232*n* (collectively referred to as horizontal corrugations 232), transverse corrugations 234*a*-234*n* (collectively referred to as transverse corrugations 234), lateral corrugations 236*a*-236*n* (collectively referred to as lateral corrugations 236), vertical channels 238*a*-238*n* (collectively referred to as vertical channels 238), horizontal channels 240*a*-240*n* (collectively referred to as horizontal channels 240), transverse channels 242*a*-242*n* (collectively referred to as transverse channels 242), lateral channels 244*a*-244*n* (collectively referred to as lateral channels 244), through holes 246*a*-246*n* (collectively referred to as through holes or through bores 246), specimen bores 248*a*-248*n* (collectively referred to as the specimen bores 248), and specimens 250 including a body 252 and a cap 254.

Figure 16:
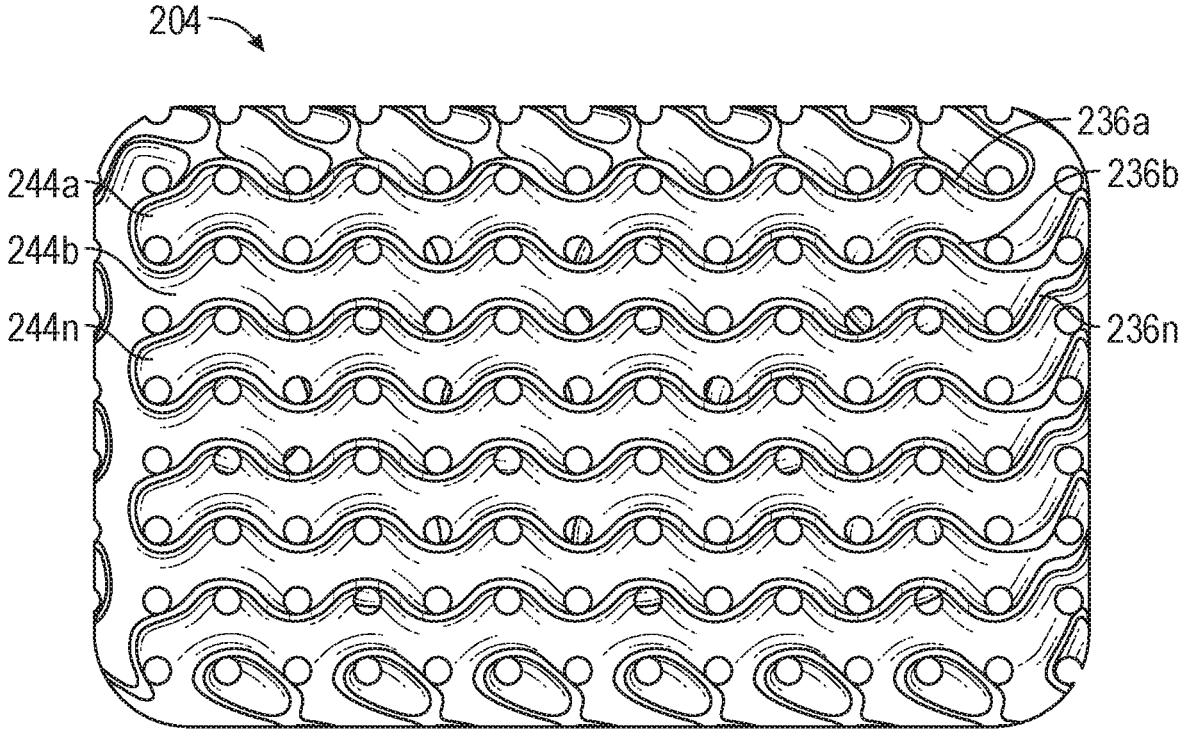
FIG. 16 illustrates a bottom elevation view of a portion of a transportation enclosure, in accordance with at least one example of this disclosure.

The carrier 204 can have a shape substantially consistent with a gyroid, which can provide a portion of an "infinite" periodic minimal surface without self-intersection. That is, the carrier 204 can include or be comprised of layered and substantially parallel ribbons or wavy or undulating corrugations that do not intersect themselves or parallel ribbons. That is, vertical parallel ribbons do not intersect themselves or each other, horizontal parallel ribbons do not intersect themselves or each other, and lateral parallel ribbons do not intersect themselves or each other; however, ribbons from transverse or non-parallel groups of ribbons may meet at certain points, as shown in FIG. 16. The shape of the carrier 204 in some examples can be a triply periodic minimal surface. The shape of the carrier 204 can also be trigonometrically approximated defined by the equation $\sin x*\cos y+\sin y*\cos z+\sin z*\cos x=0$. In some examples, the carrier 204 can have a shape of a Lidinoid. In other examples, the carrier 204 can have any shape of the Schwarz P, Schwarz D, Schwarz H, or Schwarz crossed layers of parallels (CLP) surfaces.

In some examples, as shown in FIG. 2, the vertical corrugations 230*a*-230*n* or ribbons 230 can extend from top to bottom, as also shown in FIG. 5, and can form the vertical channels 238 that are substantially parallel to each other. The horizontal corrugations 232 on the top can form horizontal channels 240 that are substantially parallel to each other and substantially transverse to the vertical channels 238. The horizontal corrugations 232 can extend from front to back (as shown in FIGS. 2 and 3). The lateral corrugations 236 on the bottom of the enclosure 204 can form the lateral channels 244 that are substantially parallel to each other and substantially transverse to the vertical channels 238 and the horizontal channels 240. The lateral corrugations 236 can extend from left to right (as shown in FIG. 16). The transverse corrugations 234 on the right side can form transverse channels 242 that are substantially parallel to each other and substantially transverse to the vertical channels 238, the horizontal channels 240, and the lateral channels 244. The transverse corrugations 234 can extend from top to bottom (as shown in FIGS. 2 and 5).

Together, the vertical corrugations 230, the horizontal corrugations 232, the transverse corrugations 234*a*, and the lateral corrugations 236 can be connected through surfaces of such corrugations such that the surfaces can be interconnected and substantially continuous. The structure of the vertical channels 238, the horizontal channels 240, the lateral channels 244, and the transverse 242 channels can provide flow paths for fluids such as air to travel naturally throughout the carrier 204.

Figure 9:
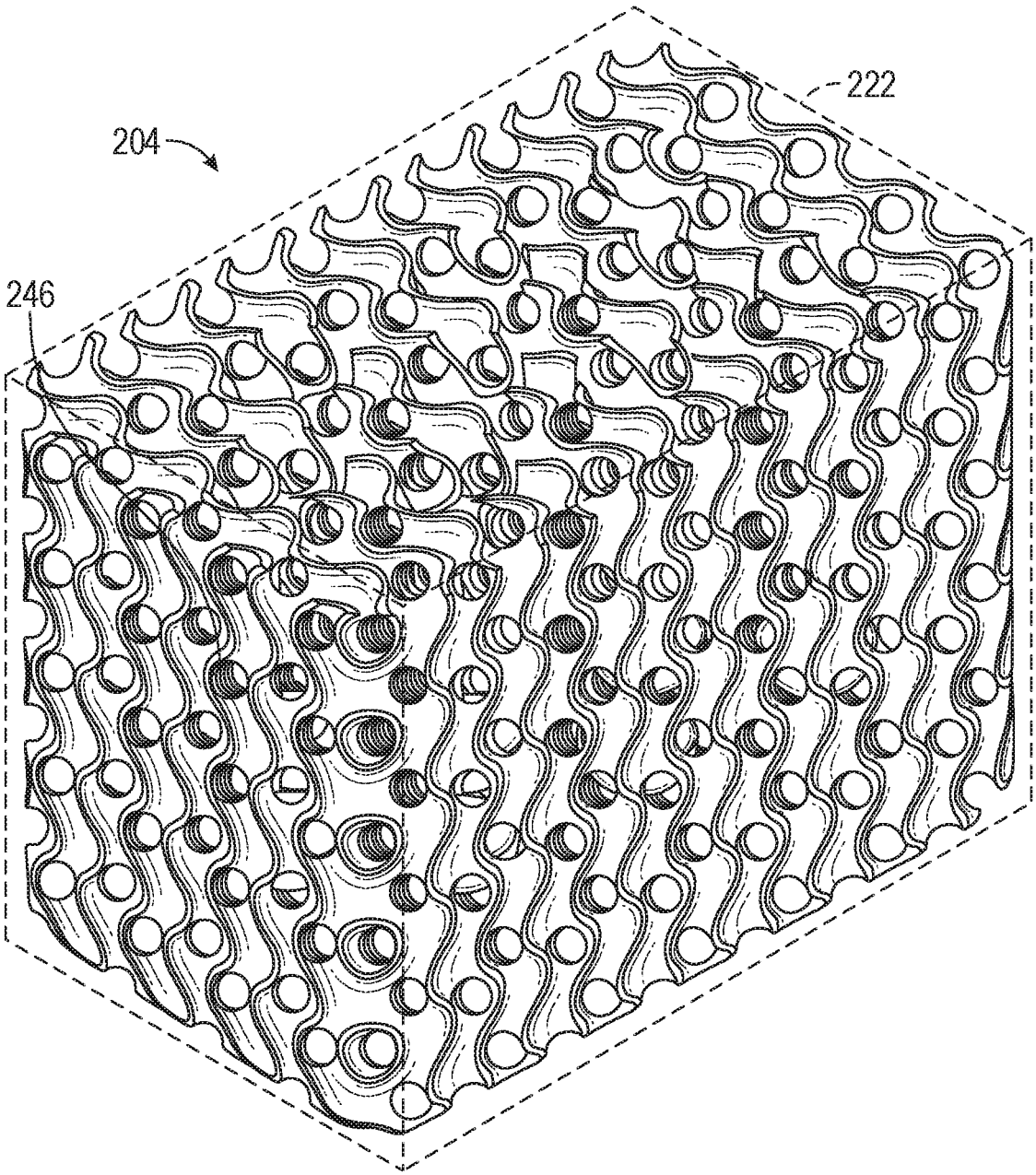
FIG. 9 illustrates an isometric view of a transportation enclosure, in accordance with at least one example of this disclosure.
Figure 10:
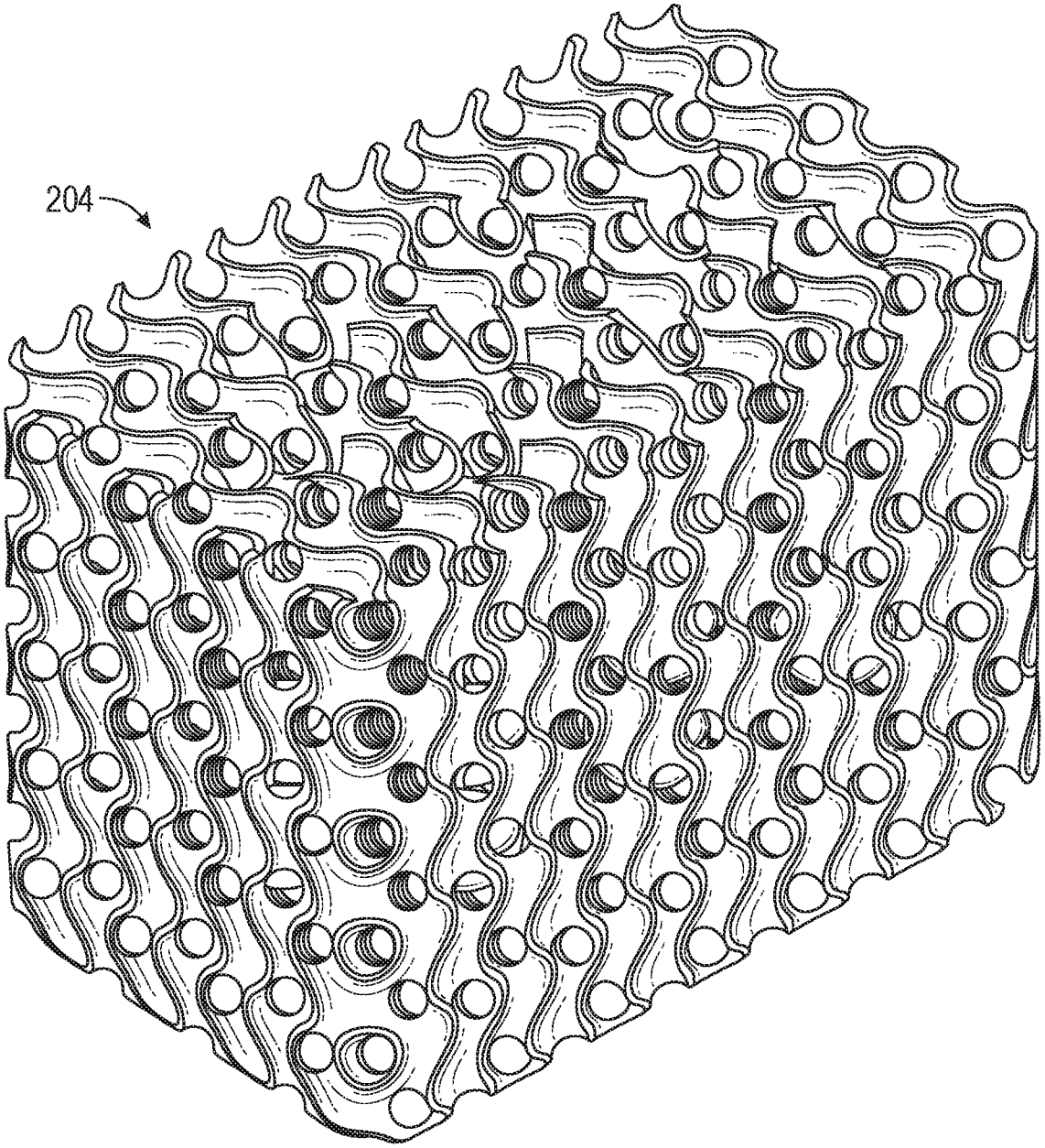
FIG. 10 illustrates an isometric view of a transportation enclosure, in accordance with at least one example of this disclosure.
Figure 12:
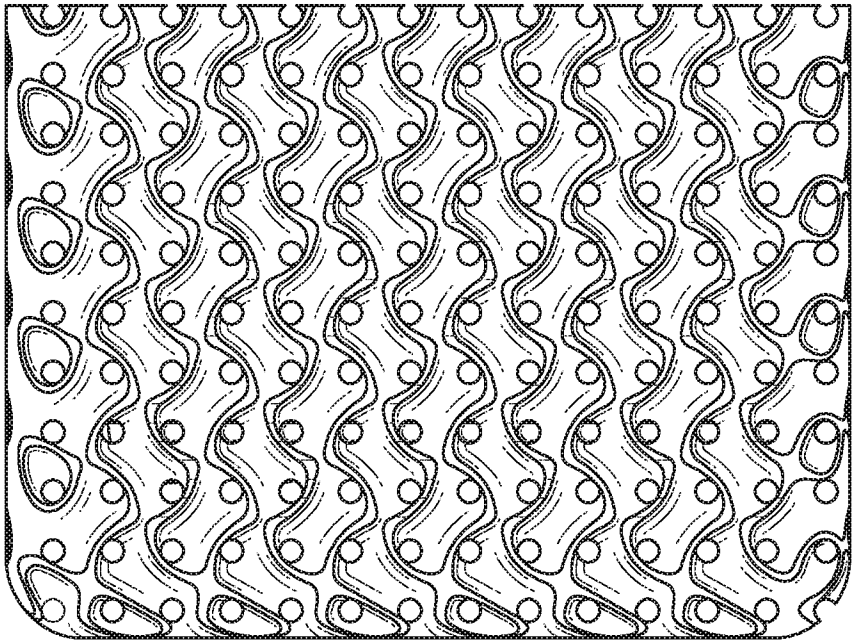
FIG. 12 illustrates a front elevation view of a portion of a transportation enclosure, in accordance with at least one example of this disclosure.
Figure 11:
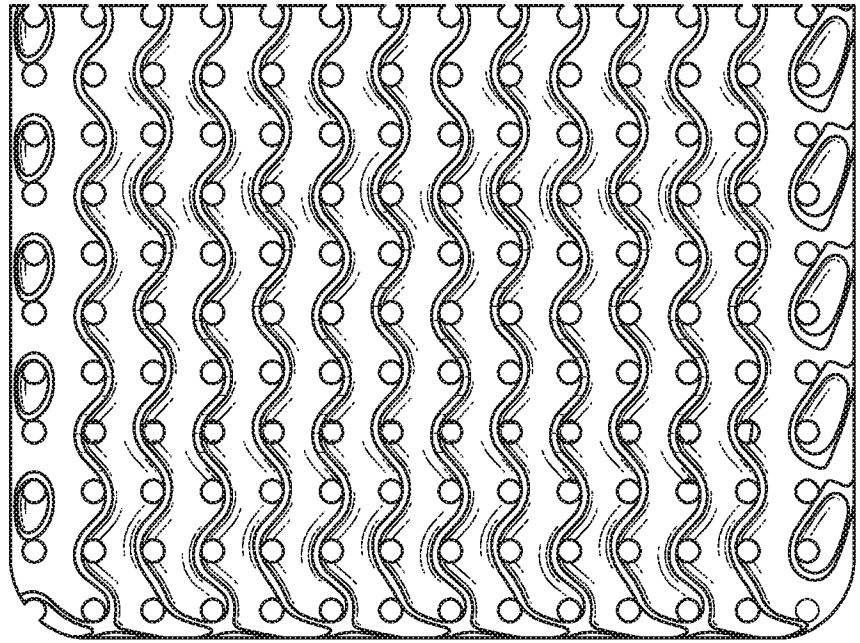
FIG. 11 illustrates a back-elevation view of a portion of a transportation enclosure, in accordance with at least one example of this disclosure.
Figure 14:
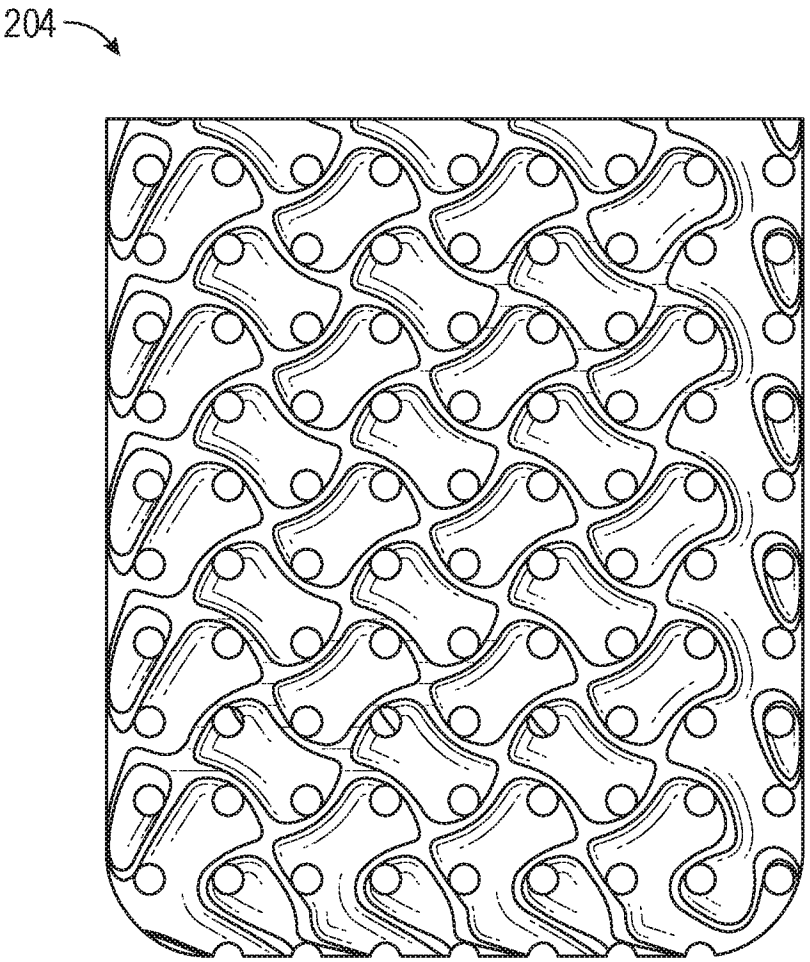
FIG. 14 illustrates a left elevation view of a portion of a transportation enclosure, in accordance with at least one example of this disclosure.
Figure 13:
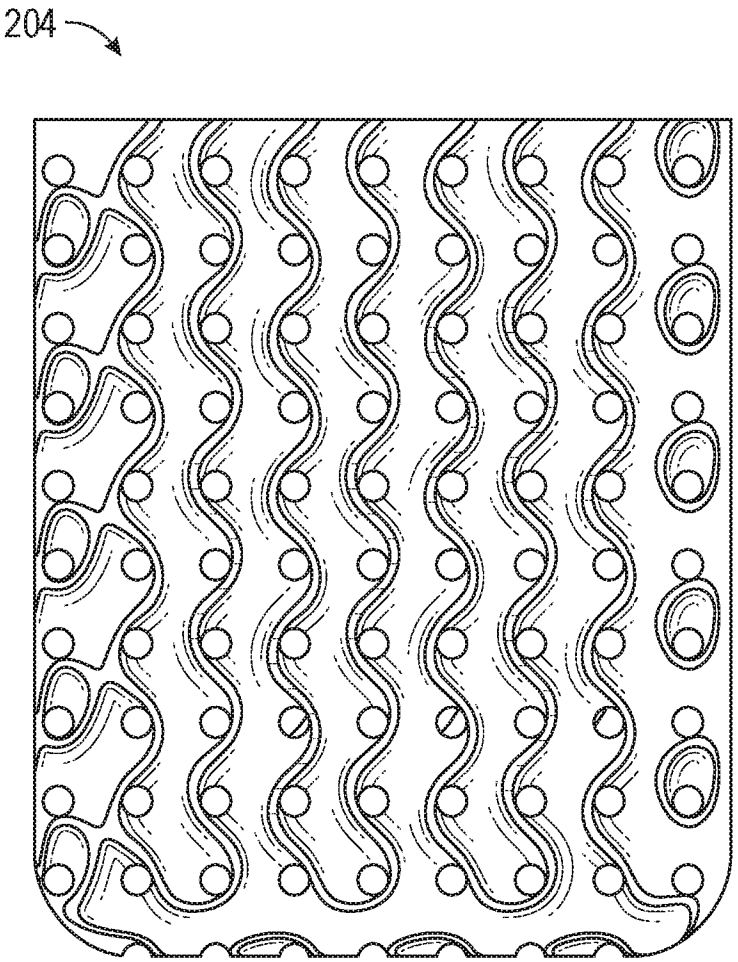
FIG. 13 illustrates a right elevation view of a portion of a transportation enclosure, in accordance with at least one example of this disclosure.
Figure 15:
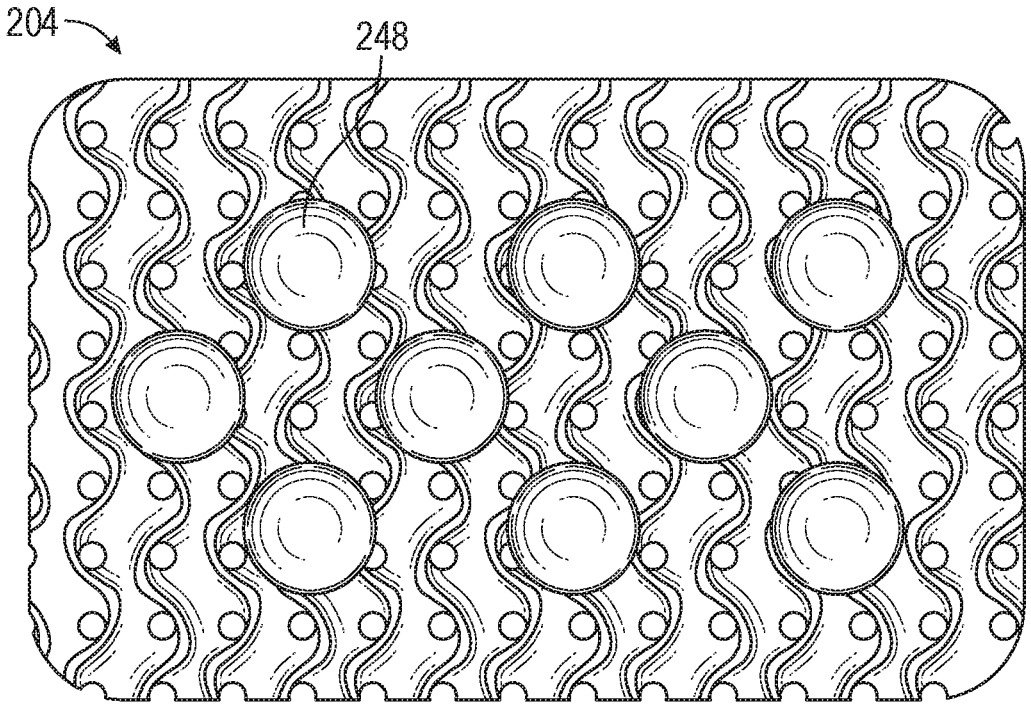
FIG. 15 illustrates a top elevation view of a portion of a transportation enclosure, in accordance with at least one example of this disclosure.

The through-holes 246 or through-bores can define bores passing through the channels and therefore between the corrugations or ribbons, such as substantially vertically (such as shown in FIG. 3) and substantially horizontally (such as shown in FIG. 7). As shown in FIG. 9, the through bores 246 can be substantially in alignment between channels to help transfer fluid therethrough, such as air. Channels and through-bores in other orientations can also be included, additionally or alternatively. As shown in FIGS. 6 and 7, which can be cross-section views of FIG. 5 across 6-6, the structure of the carrier 204 can be repetitive and can extend throughout the carrier 204.

In one example, as shown in FIGS. 4-7, the carrier 204 can have an outer geometric shape (or profile) substantially of a cuboid or a rectangular prism, such as with rounded corners. However, the carrier 204 can have other outer geometric shapes in other examples, such as an octet. The outer shape of the carrier 204 can enable placement of the carrier 204 into one or more containers, such as the enclosure 122, as shown in, and discussed with respect to, FIG. 1.

Also, as shown in FIGS. 2-7, the carrier 204 can include one or more sample bores or specimen bores 248 (or product openings 248). As shown in FIG. 3, each of the specimen bores 248 can extend from a top surface 256 of the carrier 204 into the carrier 204 and can terminate prior to extending through a bottom of the carrier 204, such that each of the specimen bores 248 can retain a specimen 250 therein. For example, as shown in FIGS. 5 and 6, the specimen or specimen containers 250 can be inserted into respective specimen bores 248 and retained therein. Though the bores 248 are shown as being round or cylindrical bores, other bore shapes such as square or triangular prism shaped can be used.

As shown in FIG. 6, when the specimens 250 are retained within the specimen bores 248, they can be connected in fluid communication to the various channels (such as the vertical channels 238 and the horizontal channels 240) and to the through-bores 246. This can help to enable effective heat transfer between the specimen containers 250 (such as tubes) and fluids (such as air) passing through the channels and bores such as to help heat or cool the specimen 250 within the enclosure 204. In some examples, these channels and bores can help to effect efficient natural convection cooling or heating throughout the carrier 204, including when the carrier 204 is placed, for example, adjacent a heat sink (passive or active), such as the heat sink 118 of FIG. 1, without requiring assistance from a fan or other air-movement assistance apparatus, but which can optionally be used with the carrier 204, if desired. In an example, the carrier 204 can be located adjacent to a thermo-electric cooler, such as the heating/cooling devices 112 shown and discussed in FIG. 1. In some examples, the specimen bores 248 can be offset from each other such as to help promote convection through the channels and bores between specimens 250.

The carrier 204 can be manufactured using, for example, one or more 3D printing techniques using one or more materials such as one or more of plastic, metal, composite, foam, or the like. The infinite periodic minimal surface without self-intersection shape can allow free-standing 3D printing of the carrier 204 such as from a solidified liquid material, without requiring use of a mold or support. In some examples, the material can be selected to provide structural rigidity sufficient to support the specimen within specimen bores without additional structure. That is, the carrier 204 can be free-standing when supporting specimens therein.

Because the carrier 204 is comprised of many interconnected layers, the structure of the carrier 204 can help to absorb forces and sudden accelerations (shocks) that may be experienced by the carrier 204 during transportation of the enclosure. This can help protect the samples 250 disposed within the carrier 204. In some examples, the material used for construction of the carrier 204 can be selected based on an ability of the material to elastically deform to help absorb forces and shocks.

Because the carrier 204 includes relatively large spaces between the layers and includes various through-bores, the carrier 204 can be relatively light in mass or weight, helping to reduce material cost and helping to save transportation cost (such as fuel cost). The material selected can also be selected for weight-saving properties to further reduce a weight of the carrier 204.

Figure 17:
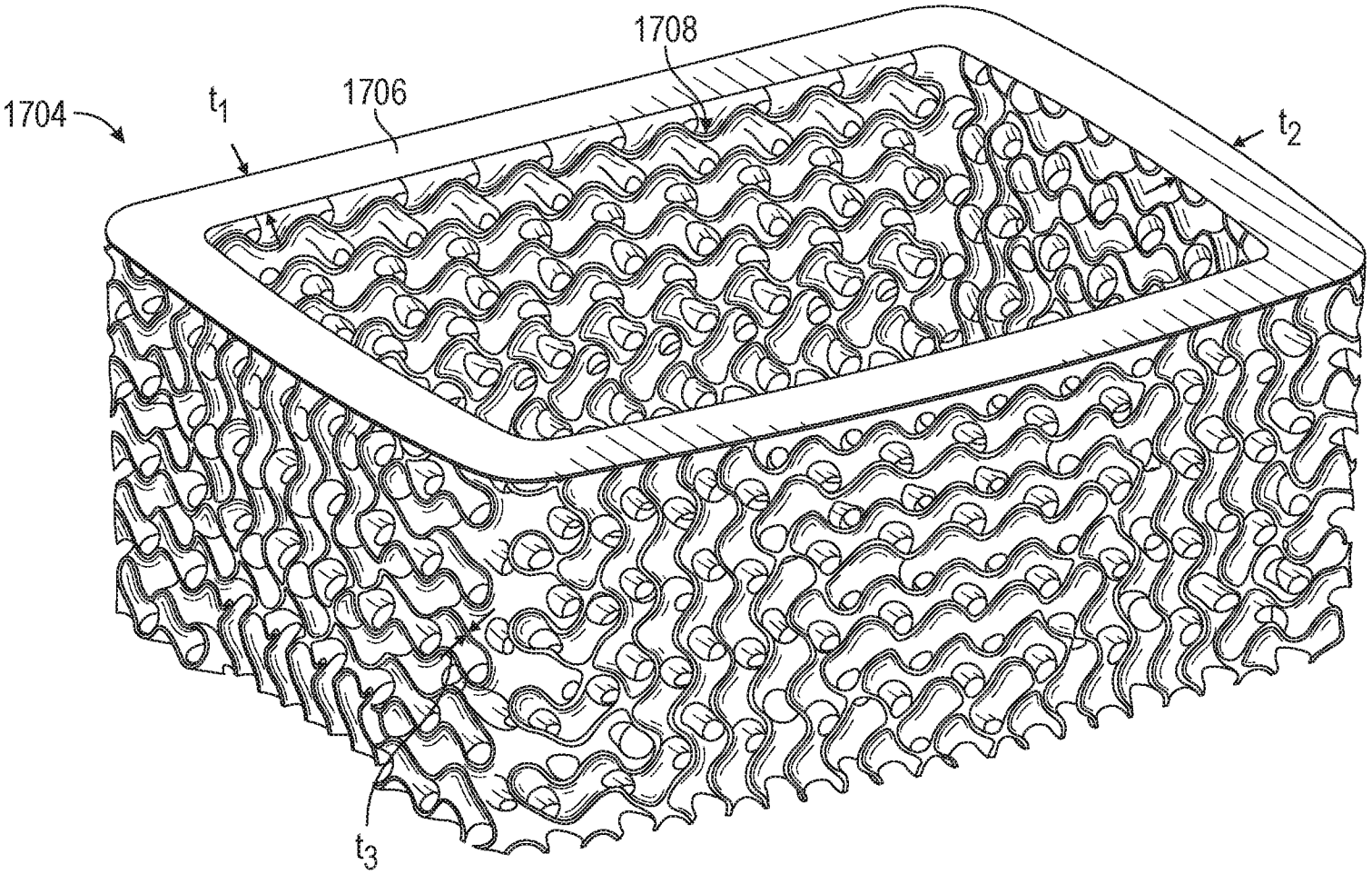
FIG. 17 illustrates an isometric view of a transportation enclosure, in accordance with at least one example of this disclosure.
Figure 18:
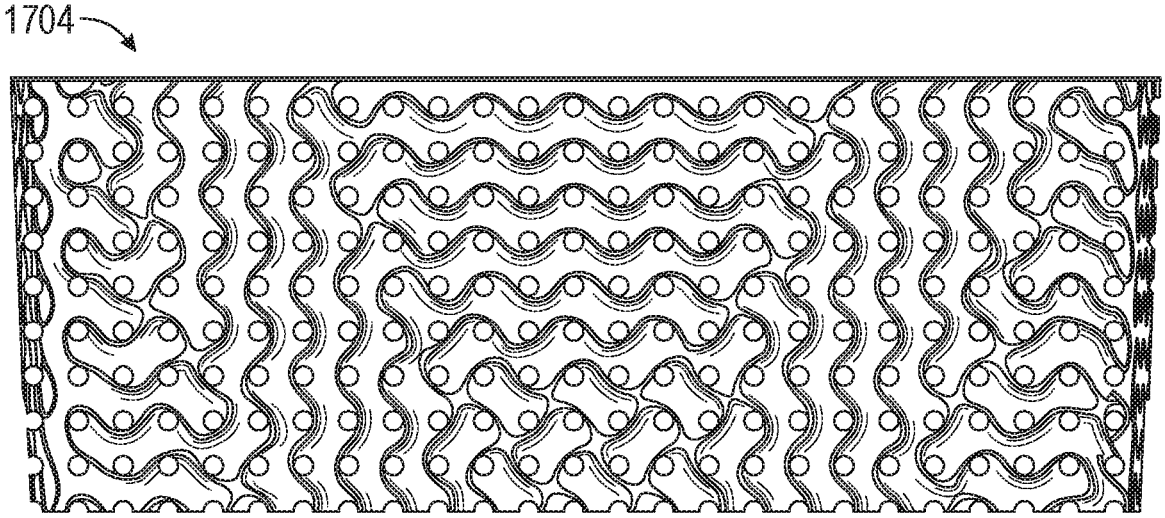
FIG. 18 illustrates a back-elevation view of a portion of a transportation enclosure, in accordance with at least one example of this disclosure.
Figure 19:
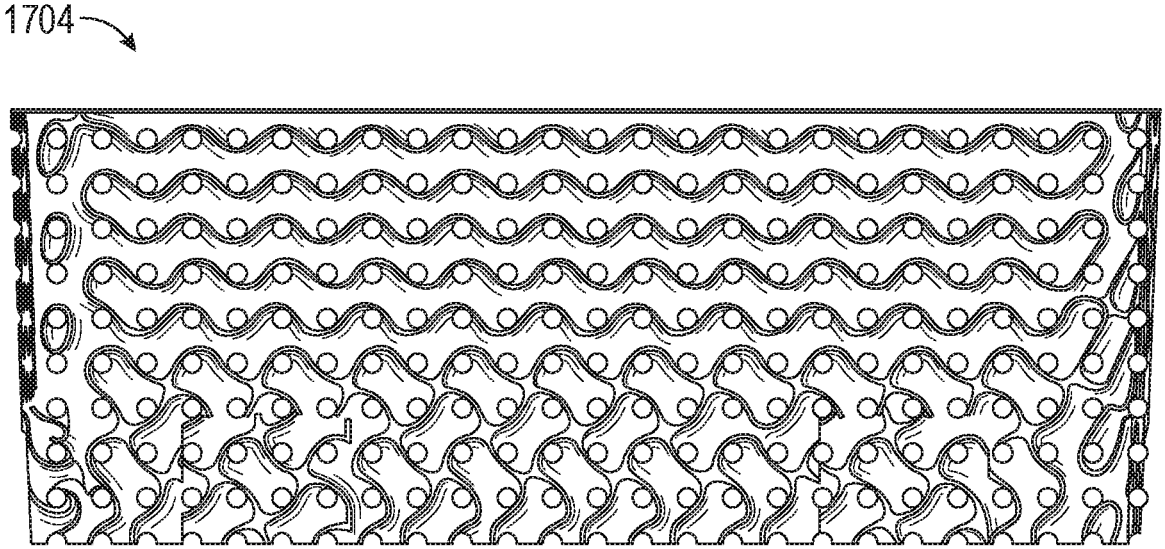
FIG. 19 illustrates a front elevation view of a portion of a transportation enclosure, in accordance with at least one example of this disclosure.
Figure 20:
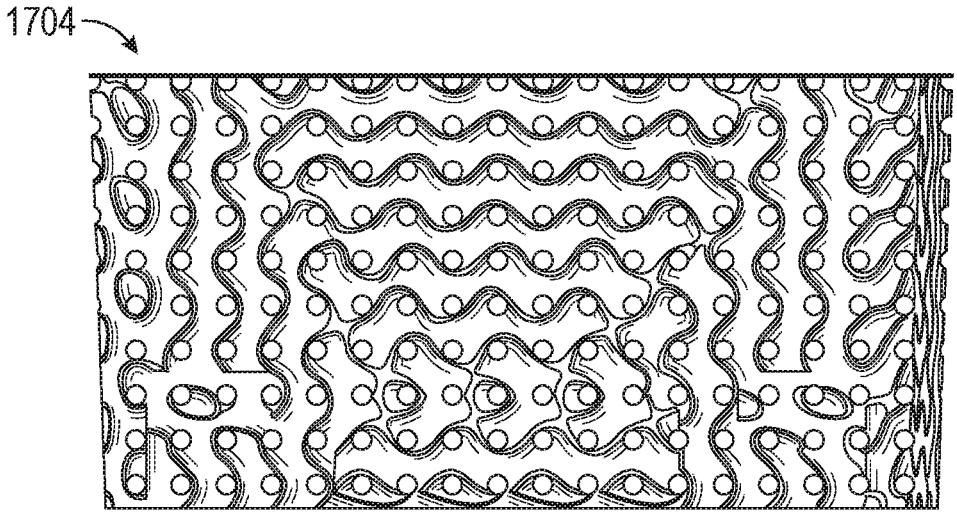
FIG. 20 illustrates a right elevation view of a portion of a transportation enclosure, in accordance with at least one example of this disclosure.
Figure 21:
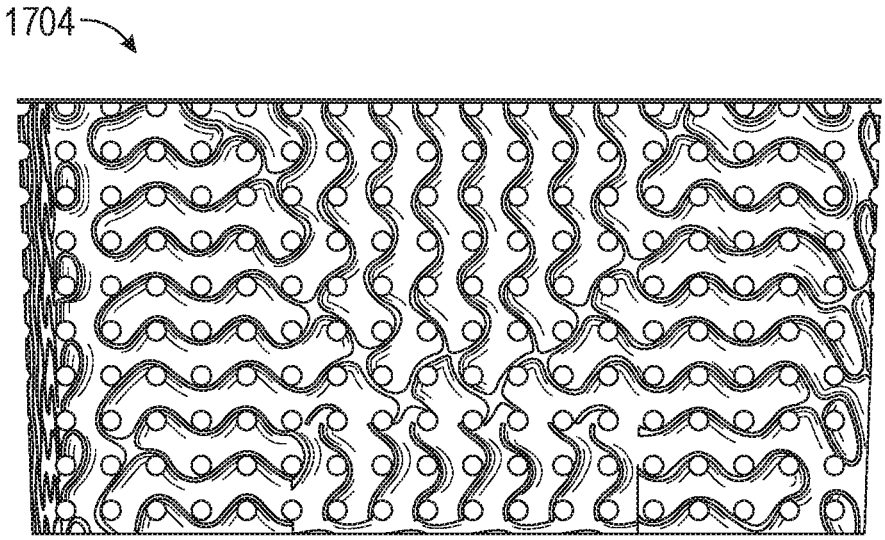
FIG. 21 illustrates a left elevation view of a portion of a transportation enclosure, in accordance with at least one example of this disclosure.
Figure 22:
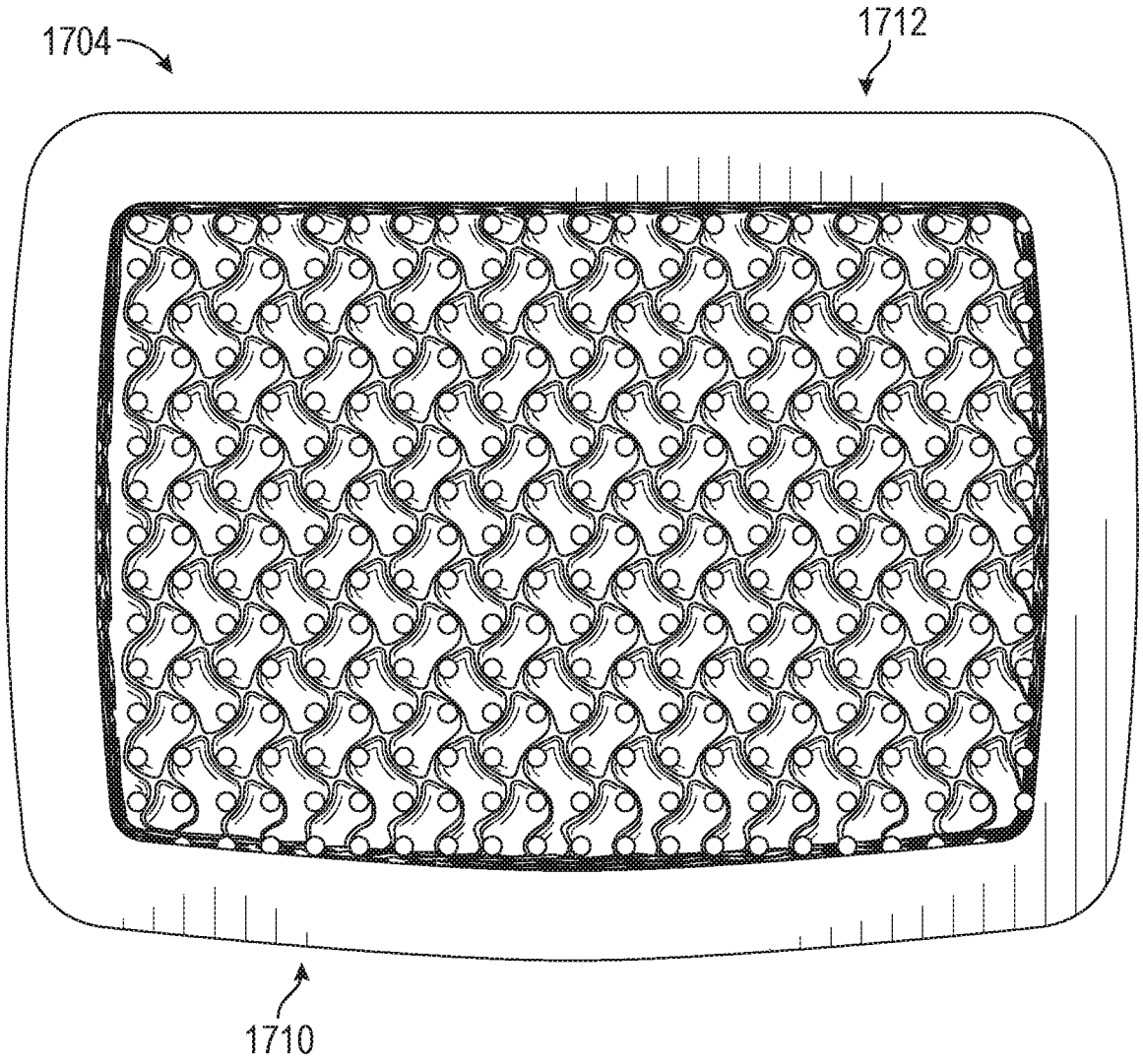
FIG. 22 illustrates a top elevation view of a portion of a transportation enclosure, in accordance with at least one example of this disclosure.
Figure 23:
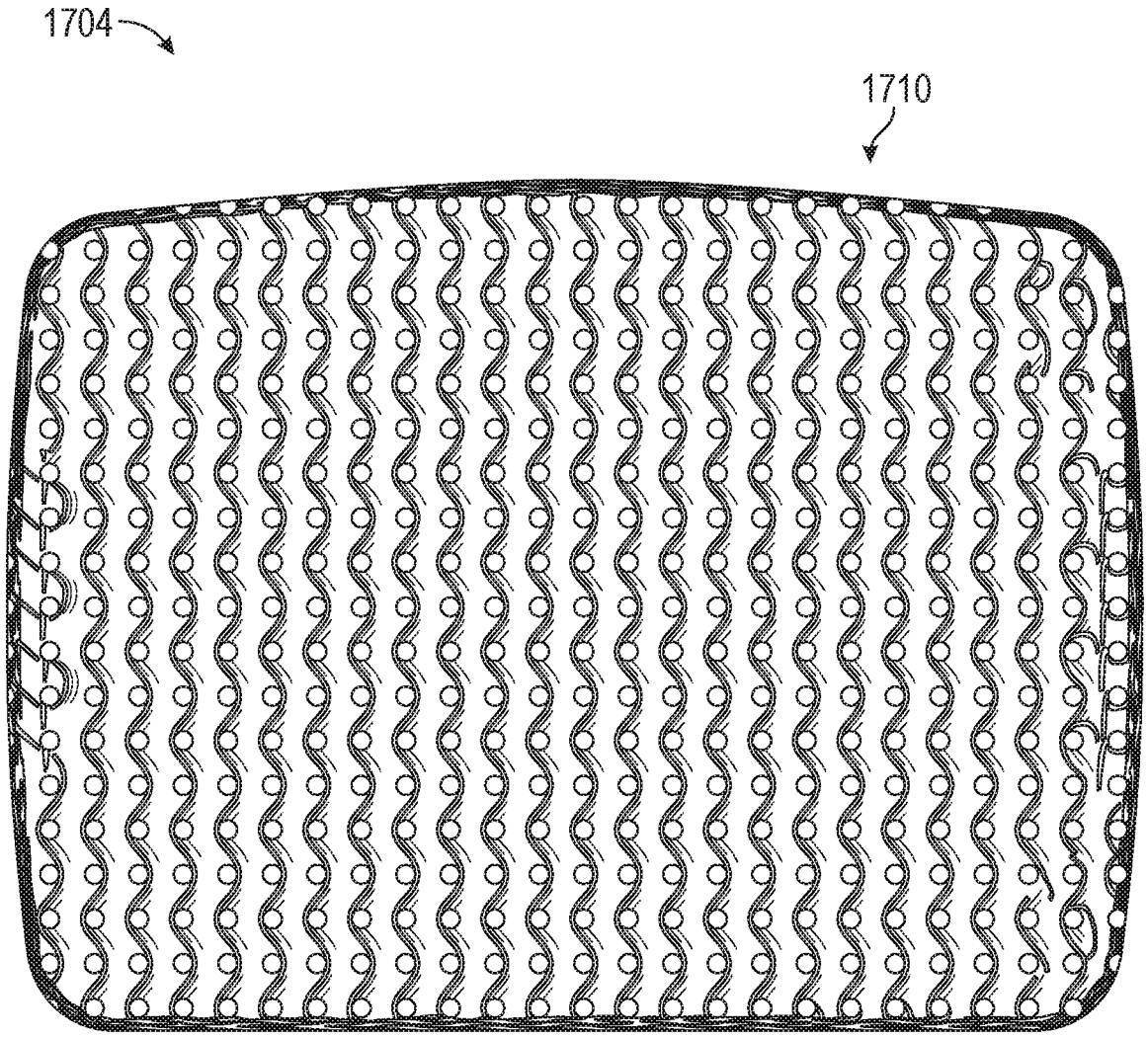
FIG. 23 illustrates a bottom elevation view of a portion of a transportation enclosure, in accordance with at least one example of this disclosure.

FIG. 17 illustrates an isometric view of a transportation carrier 1704, in accordance with at least one example of this disclosure. FIG. 18 illustrates a back-elevation view of a portion of the transportation carrier 1704, in accordance with at least one example of this disclosure. FIG. 19 illustrates a front elevation view of a portion of the transportation carrier 1704, in accordance with at least one example of this disclosure. FIG. 20 illustrates a right elevation view of a portion of the transportation carrier 1704, in accordance with at least one example of this disclosure. FIG. 21 illustrates a left elevation view of a portion of the transportation carrier 1704, in accordance with at least one example of this disclosure. FIG. 22 illustrates a top elevation view of a portion of the transportation carrier 1704, in accordance with at least one example of this disclosure. FIG. 23 illustrates a bottom elevation view of a portion of the transportation carrier 1704, in accordance with at least one example of this disclosure. FIGS. 17-23 are discussed below concurrently.

The insulation 2408 can be an infinite periodic minimal surface without self-intersection. The insulation 2408 can include or be comprised of layered and substantially parallel ribbons or wavy or undulating corrugations that do not intersect each other. That is, vertical parallel ribbons do not intersect, horizontal parallel ribbons do not intersect, and lateral parallel ribbons do not intersect, however, ribbons may beet at certain points, as discussed above. The shape of the insulation 2408 in some examples can be a triply periodic minimal surface. In some examples, the shape of the insulation 2408 can be defined by the equation sin x*cos y+Sin y*cos z+sin z*cos x=0. In some examples, the insulation 2408 can have a shape of a Lidinoid. In other examples, the insulation 2408 can have any shape of the Schwarz P, Schwarz D, Schwarz H, or Schwarz crossed layers of parallels (CLP) surfaces.

The transportation carrier 1704 can be similar to the carrier 204 discussed in detail above, except that the carrier 1704 can include an opening 1708 extending from a top surface 1706 into the carrier 1704 and terminating prior to the bottom surface such that the opening 1708 does not extend through the entire carrier 1704. The opening 1708 large relative to the size of the carrier 1704. The opening 1708 can be such that the carrier 1704 has a first thickness t1 and a second thickness t2, where the thickness t1 can be the same as the thickness t2 in some examples and can be different in other examples. In some examples, the thicknesses t1 and t2 can be a small percentage of the overall length and width of the carrier 1704, such as 20%, 15%, 10%, 5%, 4%, 3%, 2%, 1%, or the like.

Each of the thickness t1 and t2 can be configured to promote airflow through the carrier 1704 while helping to limit transfer of forces (shock and vibration) due to, for example, drops of a container that can include the carrier 1704, such as the enclosure 100 of FIG. 1. The carrier 1704 can also be configured to further limit compression, and all undesired frequencies or wavelengths of vibration, light, electromagnetic radiation, noise, or combinations thereof, from transferring to the contents within the carrier 1704. Further, individual ribbons or corrugations of the carrier 1704 can have a thickness t3, where the thickness t3 can be selected to help limit transfer of forces (shock and vibration) due to drops of a container that can include the carrier 1704, such as the enclosure 100 of FIG. 1. The enclosure 100 housing the carrier 1704 can be a parcel, an Internet of Things device, a medical cooler, and/or a refrigerated device or pallet used for transportation of temperature sensitive products. The thickness t3 also can be varied throughout the carrier 1704 along certain vectors, directions, or pathways as desired to help further limit shock, vibration, compression or transmission of light or sound wavelengths in a specific direction. A distance between corrugations can similarly be varied as desired to optimize a reduction in energy to help protect contents of the carrier 1704. The top surface 1706 can be solid or sealed and in other examples the top surface 1706 can be a continuation of the shape of the carrier 1704. In other examples, the top surface 1706 along with all of the outer perimeter of the carrier 1704 can be sealed to allow the opening 1708 of the carrier 1704 to be in vacuum.

In operation, the carrier 1704 can be configured to receive one or more items within the opening 1708, which can serve as a cushion or pad-like liner along an interior portion of an enclosure such as the enclosure 100, to help protect contents within the opening 1708 while helping to promote flow to the contents of the carrier 1704 through the various channels and bores of the carrier 1704.

In some examples, as shown in FIGS. 22 and 23 a front side 1710 can curve away from a back side 1712 of the carrier 1704 such that the front side is bowed away from the opening 1708. In other examples, all or none of the sides of the carrier can be curved or bowed.

Figure 24:
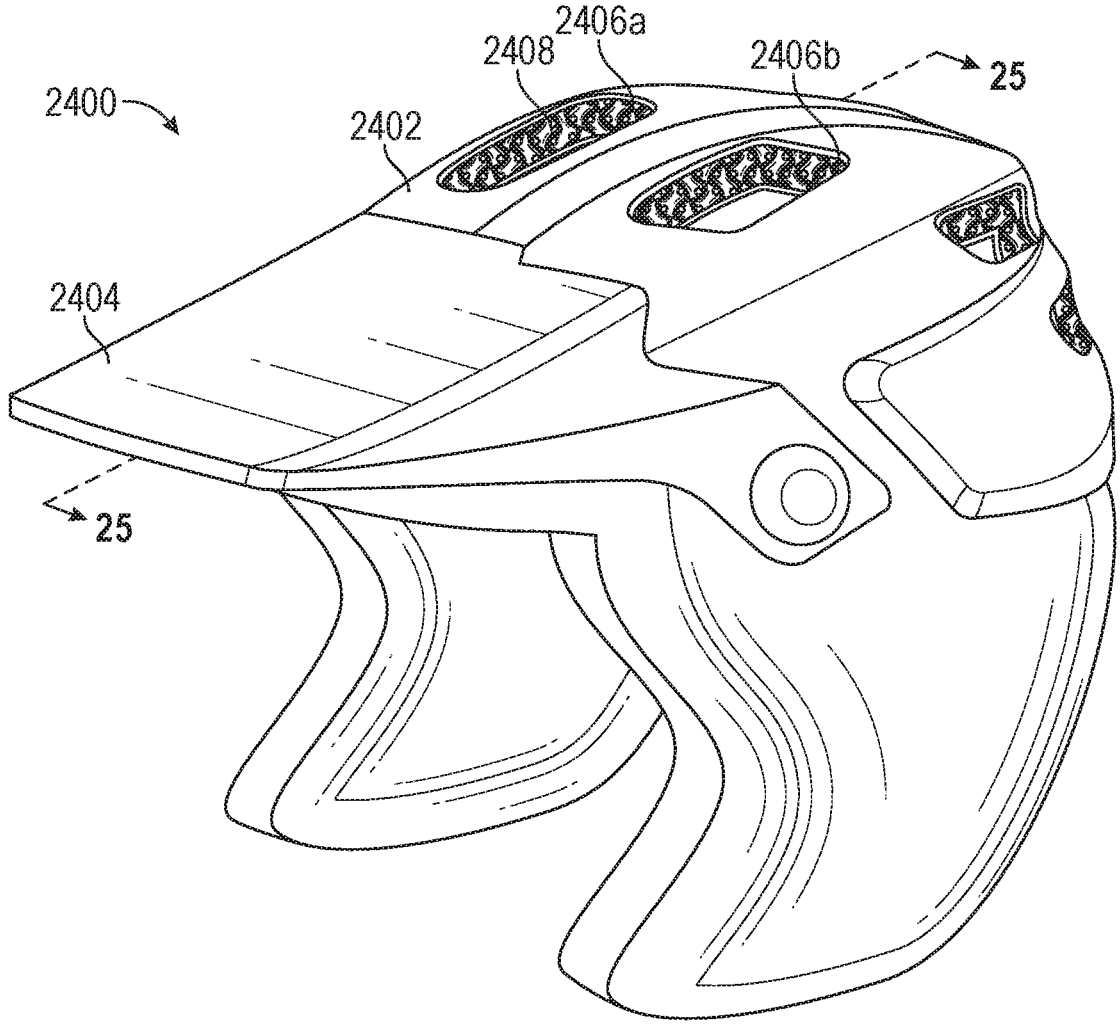
FIG. 24 illustrates an isometric view of a helmet including a layer of insulation having a periodic minimal surface without self-intersection, in accordance with at least one example of this disclosure.
Figure 25:
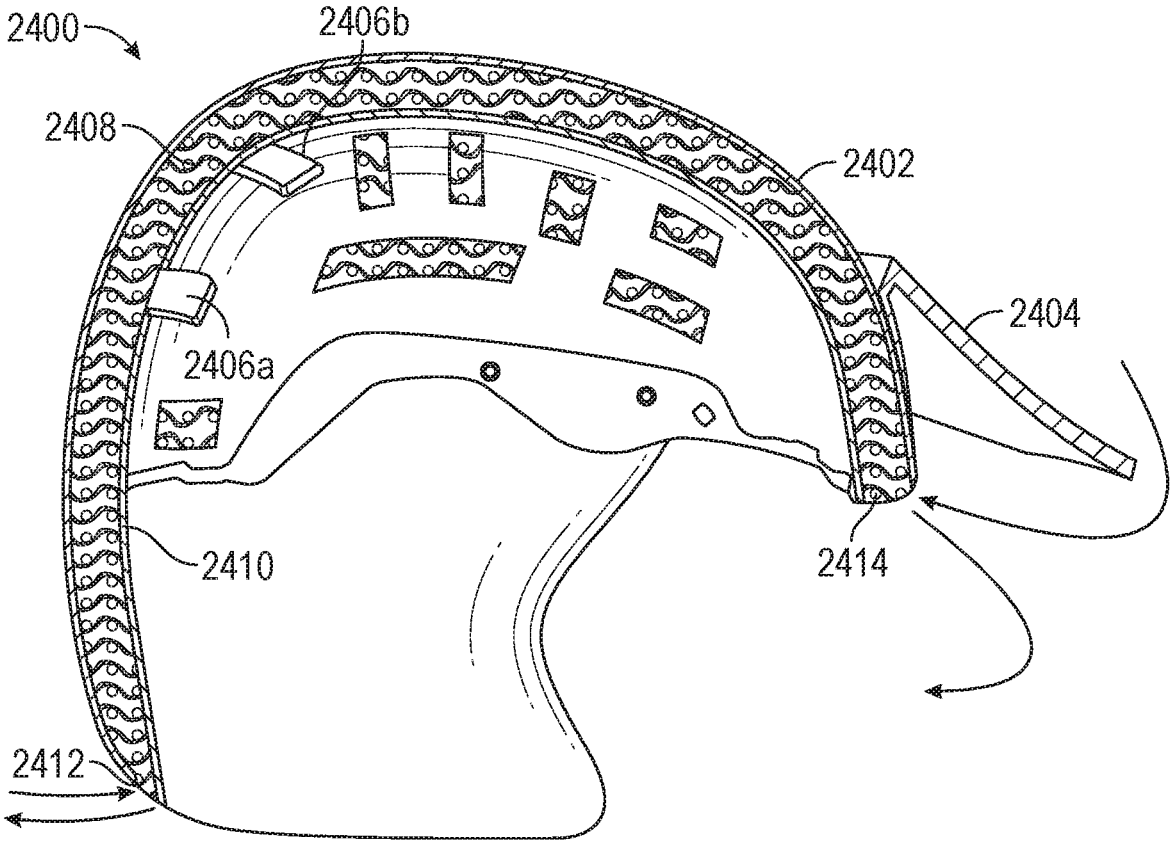
FIG. 25 illustrates a cross section view of a helmet including a layer of insulation having a periodic minimal surface without self-intersection, in accordance with at least one example of this disclosure.

FIG. 24 illustrates an isometric view of a helmet 2400 including a layer of insulation having a triply periodic minimal surface, in accordance with at least one example of this disclosure. FIG. 25 illustrates a cross section view of the helmet 2400 including a layer of insulation having a triply periodic minimal surface, in accordance with at least one example of this disclosure. FIGS. 24 and 25 are discussed below concurrently.

The helmet 2400 can include an outer shell 2402, a visor 2404, vents 2406, insulation 2408, an inner shell 2410, and openings 2412 and 2414. The helmet 2400 can be a helmet for wearing during activities such as biking, riding a motorcycle, playing sports, or the like. The helmet 2400 can be configured to protect a head of a rider or wearer during such activities.

The outer shell 2402, the inner shell 2410, and the visor 2404 can be rigid or semi-rigid bodies comprised of materials such as one or more of metals, plastics, foams, elastomers, ceramics, composites, combinations thereof, or the like. The outer shell 2402 can provide an outer casing for the insulation 2408 and can help absorb received forces due to deformation upon impact. The inner shell 2410 can provide a similar function upon impact and can also help retain the insulation on an inside of the helmet 2400. The visor 2404 can be optionally include and can be connected to the outer shell 2402 and/or the inner shell.

The vents 2406 can extend through the outer shell 2402, the inner shell 2410, and the insulation to provide airflow for cooling during use or wearing of the helmet 2400. The vents 2406 can also allow for air to enter and exit the insulation layer 2408, as discussed below in further detail.

The insulation 2408 can be an infinite periodic minimal surface without self-intersection. The insulation 2408 can include or be comprised of layered and substantially parallel ribbons or wavy or undulating corrugations that do not intersect each other. That is, vertical parallel ribbons do not intersect, horizontal parallel ribbons do not intersect, and lateral parallel ribbons do not intersect, however, ribbons may beet at certain points, as discussed above. The shape of the insulation 2408 in some examples can be a triply periodic minimal surface. In some examples, the shape of the insulation 2408 can be defined by the equation sin x*cos y+Sin y*cos z+sin z*cos x=0. In some examples, the insulation 2408 can have a shape of a Lidinoid. In other examples, the insulation 2408 can have any shape of the Schwarz P, Schwarz D, Schwarz H, or Schwarz crossed layers of parallels (CLP) surfaces.

By having such a shape, the insulation 2408 can be configured to promote a natural flow of air through the insulation 2408, which can help improve cooling of a wearer of the helmet 2408. Further, the shape of the insulation and the interconnections between the layers or ribbons can help maintain a relatively high strength or ability to absorb shock and forces while providing flow paths for cooling. The insulation 2408 can also help to protect human ears from unwanted frequencies while allowing air to pass through for thermal and pressure equilibrium.

The openings 2412 and 2414 can be ends of the insulation 2408 exposed to the ambient environment through openings in the inner shell 2410 and the outer shell 2412. The openings 2412 and 2414 together with the vents 2406 can allow air to move in an out of the insulation 2408.

Notes and Examples

In one example, the gyroid carrier can be an interchangeable housing in some examples, where gyroid carriers can be customized design to each specimen size or container size. The gyroid carrier can help promote even distribution of heating or cooling into each 'sectional area' of the compartment, helping to promote heat transfer through natural convection. The gyroid carrier can also provide energy-absorbing structural strength to help protect specimens or enclosures thereof from damage during transportation. Because the gyroid carrier is inherently structural, it does not require additional support, which can help reduce cost.

The following, non-limiting examples, detail certain aspects of the present subject matter to solve the challenges and provide the benefits discussed herein, among others.

Example 1 is a portable fluid transportation enclosure comprising: a gyroid carrier defining one or more specimen bores therein, each specimen bore configured to receive a specimen therein.

In Example 2, the subject matter of Example 1 optionally includes wherein the gyroid carrier comprises a geometric shape of a gyroid.

In Example 3, the subject matter of Example 2 optionally includes wherein the geometric shape is substantially a cuboid.

In Example 4, the subject matter of any one or more of Examples 1-3 optionally include wherein the gyroid carrier is at least partially defined by a plurality of substantially parallel corrugated horizontal surfaces.

In Example 5, the subject matter of Example 4 optionally includes wherein the gyroid carrier is at least partially defined by a plurality of substantially parallel corrugated vertical surfaces.

In Example 6, the subject matter of Example 5 optionally includes wherein the corrugated vertical surfaces together form a plurality of vertical flow paths through the gyroid carrier.

In Example 7, the subject matter of any one or more of Examples 5-6 optionally include wherein the corrugated horizontal surfaces together form a plurality of horizontal flow paths through the gyroid carrier.

In Example 8, the subject matter of any one or more of Examples 1-7 optionally include wherein the plurality of vertical flow paths together with the plurality of horizontal flow paths are configured to promote air flow through the gyroid and around the specimen bores to promote heat transfer between tubes disposed in the specimen bores and air passing through the plurality of vertical flow paths and the plurality of horizontal flow paths.

In Example 9, the subject matter of any one or more of Examples 4-8 optionally include wherein the gyroid carrier is at least partially defined by a plurality of through-bores.

In Example 10, the subject matter of any one or more of Examples 1-9 optionally include a heat sink adjacent the gyroid, the heat sink configured to transfer heat between air within the fluid transportation enclosure and an ambient environment.

In Example 11, the subject matter of any one or more of Examples 1-9 optionally include wherein the heatsink includes a thermos-electric cooler.

In Example 12, the system, assembly, or method of any one of or any combination of Examples 1-11 is optionally configured such that all elements or options recited are available to use or select from.

Example 13 is a portable transportation enclosure comprising: a gyroid carrier defining one or more tube bores therein, each specimen bore configured to receive a specimen therein.

In Example 14, the subject matter of Example 13 optionally includes wherein the gyroid carrier comprises a geometric shape of a gyroid.

In Example 15, the subject matter of Example 14 optionally includes wherein the geometric shape is substantially a cuboid geometry.

In Example 16, the subject matter of any one or more of Examples 13-15 optionally include wherein the gyroid carrier is at least partially defined by a plurality of substantially parallel corrugated horizontal surfaces.

In Example 17, the subject matter of Example 16 optionally includes wherein the gyroid carrier is at least partially defined by a plurality of substantially parallel corrugated vertical surfaces.

In Example 18, the subject matter of Example 17 optionally includes wherein the corrugated vertical surfaces together form a plurality of vertical flow paths through the gyroid carrier.

In Example 19, the subject matter of any one or more of Examples 17-18 optionally include wherein the corrugated horizontal surfaces together form a plurality of horizontal flow paths through the gyroid carrier.

In Example 20, the subject matter of any one or more of Examples 16-19 optionally include wherein the plurality of vertical flow paths together with the plurality of horizontal flow paths are configured to promote air flow through the gyroid carrier and around the specimen bores to promote heat transfer between tubes disposed in the specimen bores and air passing through the plurality of vertical flow paths and the plurality of horizontal flow paths.

In Example 21, the subject matter of any one or more of Examples 16-20 optionally include wherein the gyroid carrier is at least partially defined by a plurality of through-bores.

In Example 22, the subject matter of any one or more of Examples 13-21 optionally include a heat sink adjacent the gyroid carrier, the heat sink configured to transfer heat between air within the portable transportation enclosure and an ambient environment.

In Example 23, the subject matter of any one or more of Examples 13-22 optionally include wherein the heat sink includes a thermo-electric cooler.

Example 24 is a portable enclosure comprising: a carrier having a shape of a periodic minimal surface defining one or more product openings therein, each product opening configured to receive a product therein.

In Example 25, the subject matter of Example 24 optionally includes wherein the carrier has a shape of a Schwarz surface.

In Example 26, the subject matter of Example 25 optionally includes wherein the carrier shape is one of a P type, D type, H type, or CLP type Schwarz surface.

In Example 27, the subject matter of Example 26 optionally includes wherein a geometric perimeter shape of the carrier is substantially a cuboid.

In Example 28, the subject matter of any one or more of Examples 24-27 optionally include wherein the carrier is at least partially defined by a plurality of substantially parallel corrugated horizontal surfaces, a plurality of substantially parallel corrugated vertical surfaces, a plurality of substantially parallel corrugated lateral surfaces, and a plurality of substantially parallel corrugated transverse surfaces.

In Example 29, the subject matter of Example 28 optionally includes wherein the corrugated vertical surfaces together form a plurality of vertical flow paths through the carrier, and wherein the corrugated horizontal surfaces together form a plurality of horizontal flow paths through the carrier.

In Example 30, the subject matter of Example 29 optionally includes wherein the plurality of vertical flow paths together with the plurality of horizontal flow paths are configured to promote air flow through the gyroid and around the product openings to promote heat transfer between products disposed in the product openings and air passing through the plurality of vertical flow paths and the plurality of horizontal flow paths.

In Example 31, the subject matter of any one or more of Examples 24-30 optionally include wherein the carrier is at least partially defined by a plurality of through-bores.

Example 32 is a transportation system comprising: a container including outer walls and defining an opening therein; and a carrier positionable within the opening of the container, the carrier defining a cavity configured to receive a product, the carrier having a shape of a periodic minimal surface.

In Example 33, the subject matter of Example 32 optionally includes a heat sink connected to the cavity and the chamber to exchange heat with an ambient environment.

In Example 34, the subject matter of Example 33 optionally includes a heating/cooling device in thermal communication with the heat sink to transfer heat between the heat sink and the ambient environment.

In Example 35, the subject matter of Example 34 optionally includes wherein the heating/cooling device is a thermoelectric cooler.

Example 36 is a helmet comprising: an outer shell; and insulation positioned inside the outer shell, the insulation having a triply periodic minimal surface.

In Example 37, the subject matter of Example 36 optionally includes an inner shell position on an inside of the helmet and securing the insulation.

In Example 38, the subject matter of any one or more of Examples 36-37 optionally include wherein the inner shell and/or outer shell include one or more vents or openings therein to promote airflow between an ambient environment and the insulation.

In Example 39, the apparatuses, systems, or method of any one or any combination of Examples 1-38 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A portable transportation enclosure comprising:

a gyroid carrier defining one or more specimen bores therein, each specimen bore configured to receive a specimen therein.

2. The portable transportation enclosure of claim 1, wherein the gyroid carrier comprises a geometric shape of a gyroid.

3. The portable transportation enclosure of claim 2, wherein the geometric shape is a cuboid geometry.

4. The portable transportation enclosure of claim 1, wherein the gyroid carrier is at least partially defined by a plurality of parallel corrugated horizontal surfaces.

5. The portable transportation enclosure of claim 4, wherein the gyroid carrier is at least partially defined by a plurality of parallel corrugated vertical surfaces.

6. The portable transportation enclosure of claim 5, wherein the corrugated vertical surfaces together form a plurality of vertical flow paths through the gyroid carrier.

7. The portable transportation enclosure of claim 5, wherein the corrugated horizontal surfaces together form a plurality of horizontal flow paths through the gyroid carrier.

8. The portable transportation enclosure of claim 7, wherein the plurality of vertical flow paths together with the plurality of horizontal flow paths are configured to promote air flow through the gyroid carrier and around the specimen bores to promote heat transfer between tubes disposed in the specimen bores and air passing through the plurality of vertical flow paths and the plurality of horizontal flow paths.

9. The portable transportation enclosure of claim 4, wherein the gyroid carrier is at least partially defined by a plurality of through-bores.

10. The portable transportation enclosure of claim 1, further comprising:

a heat sink adjacent the gyroid carrier, the heat sink configured to transfer heat between air within the portable transportation enclosure and an ambient environment.

11. The portable transportation enclosure of claim 1, wherein the heat sink includes a thermo-electric cooler.

12. A portable enclosure comprising:

a carrier having a shape of a triply periodic minimal surface defining one or more product openings therein, each product opening configured to receive a product therein.

13. The enclosure of claim 12, wherein the shape of the carrier is a Schwarz surface.

14. The enclosure of claim 13, wherein the carrier shape is one of a P type, D type, H type, or CLP type Schwarz surface.

15. The enclosure of claim 14, wherein a geometric perimeter shape of the carrier is a cuboid.

16. The enclosure of claim 12, wherein the carrier is at least partially defined by a plurality of parallel corrugated horizontal surfaces, a plurality of substantially parallel corrugated vertical surfaces, a plurality of parallel corrugated lateral surfaces, and a plurality of parallel corrugated transverse surfaces.

17. The enclosure of claim 16, wherein the corrugated vertical surfaces together form a plurality of vertical flow paths through the carrier, and wherein the corrugated horizontal surfaces together form a plurality of horizontal flow paths through the carrier.

18. The enclosure of claim 17, wherein the plurality of vertical flow paths together with the plurality of horizontal flow paths are configured to promote air flow through the gyroid and around the product openings to promote heat transfer between products disposed in the product openings and air passing through the plurality of vertical flow paths and the plurality of horizontal flow paths.

19. The enclosure of claim 12, wherein the carrier is at least partially defined by a plurality of through-bores.

20. A transportation system comprising:

a container including outer walls and defining an opening therein; and a carrier positionable within the opening of the container, the carrier defining a cavity configured to receive a product, the carrier having a shape of a triply periodic minimal surface.

* * * * *